US006028308A

United States Patent [19]

Hager

[11] Patent Number: 6,028,308

[45] Date of Patent: Feb. 22, 2000

[54] RESOLVING RF MASS SPECTROMETER

[75] Inventor: James W. Hager, Mississauga, Canada

[73] Assignee: MDS Inc., Etobicoke, Canada

[21] Appl. No.: 08/957,936

[22] Filed: Oct. 27, 1997

Related U.S. Application Data

[60] Provisional application No. 60/031,296, Nov. 18, 1996.

[51] Int. Cl.[7] ..... H01J 49/42

[52] U.S. Cl. ..... 250/282; 250/292

[58] Field of Search ..... 250/292, 282

[56] References Cited

U.S. PATENT DOCUMENTS

| | | | |
|---|---|---|---|
| 3,147,445 | 9/1964 | Wuerker et al. | 330/4.7 |
| 3,321,623 | 5/1967 | Brubaker et al. | 250/292 |
| 4,023,398 | 5/1977 | French et al. | 73/23 |
| 4,090,075 | 5/1978 | Brinkmann | 250/282 |
| 4,816,675 | 3/1989 | Fies et al. | 250/292 |
| 5,089,703 | 2/1992 | Schoen et al. | 250/292 |

FOREIGN PATENT DOCUMENTS

| | | | |
|---|---|---|---|
| 0 217 644 | 4/1987 | European Pat. Off. . | |
| 0 237 259 | 9/1987 | European Pat. Off. | 250/292 |
| 0 567 276 | 10/1993 | European Pat. Off. . | |

OTHER PUBLICATIONS

U. Brinkman, Int. J. Mass Spectrom. Ion Phys. 9(1972) 161–166.

J. Yang and J.H. Leck, Int. J. Mass Spectrom. Ion Phys. 60(1984) 127–136.

P.H. Dawson, *The Acceptance of the Quadrupole Mass Filter*, International Journal of Mass Spectrometry and Ion Physics, vol. 17, 1975, Amsterdam NL, p. 423–445.

*Primary Examiner*—Jack I. Berman
*Attorney, Agent, or Firm*—Bereskin & Parr

[57] ABSTRACT

A method of operating a mass spectrometer having a rod set, comprising: directing ions into the rod set, applying an unbalanced RF voltage to the rod set, and applying a low level resolving DC voltage, e.g. 0.3 to 15.5 volts, to the rod set, thus increasing the sensitivity of the mass spectrometer and also improving the resolution. Alternatively, instead of unbalancing the RF voltage on the rod set, suitably phased RF can be applied to an end lens spaced from the exit end of the rod set.

11 Claims, 23 Drawing Sheets

RESOLVING RF MASS SPECTROMETER

RELATED APPLICATION

This application claims the benefit of U.S. provisional application No. 60/031,296 filed Nov. 18, 1996.

FIELD OF THE INVENTION

This invention relates to a mass analyzer. More particularly, it relates to a rod type mass analyzer which is simple and inexpensive and yet which is able to provide good mass resolution.

BACKGROUND OF THE INVENTION

Quadrupole mass spectrometers are commonly used to perform mass analysis. These spectrometers, when used in a resolving mode, employ 4 rods which are usually relatively lengthy (e.g., 20 cm) and which are both made and assembled with extreme precision. When used in a resolving mode they are pumped to a relatively high vacuum (e.g. $10^{-5}$ Torr) and both RF and DC voltages are applied to them. While the RF and DC voltages can vary depending on the frequency of operation and the mass range, typical values for the RF are of the order of 1600 volts peak-to-peak at 1 MHz, and for the DC typically ±272 volts peak-to-peak. (These values are typical for a mass range of 600 Daltons and an inscribed radius $r_0$ for the rod set of 0.415 cm.) The costs of such mass spectrometers, including their associated power supplies and vacuum pumps, are usually extremely high.

There has for many years existed a need for a simpler less expensive mass spectrometer, and numerous attempts have been made to fill this need. However while the costs have been reduced, quadrupole and other rod mass spectrometers (e.g., octopoles and hexapoles) have continued to remain extremely expensive and to require very close tolerances and high vacuum pumping equipment, as well as costly power supplies.

BRIEF SUMMARY OF THE INVENTION

Therefore it is an object of the invention to provide a rod type mass spectrometer which achieves good results but with simpler, shorter, less precisely made resolving rods than have previously been needed, and with less costly vacuum pumping and power supply equipment. In one aspect the invention provides a method of operating a mass spectrometer having a rod set, comprising: a method of operating a mass spectrometer having a rod set which has at least two pole pairs and an exit end, said method comprising directing ions into or forming ions in said rod set, transmitting ions from said exit end of said rod set as transmitted ions, applying RF to said rod set, aligning some of said transmitted ions with one said pole pair and the number of transmitted ions being aligned with said one pole pair being greater than the number of transmitted ions not so aligned, and ejecting the ions aligned with said one pole pair from said exit end with greater kinetic energy than the ions not so aligned.

Further objects and advantages of the invention will appear from the following description, taken together with the accompanying drawings.

DETAILED DESCRIPTION OF PREFERRED EMBODIMENTS

Figure 1:
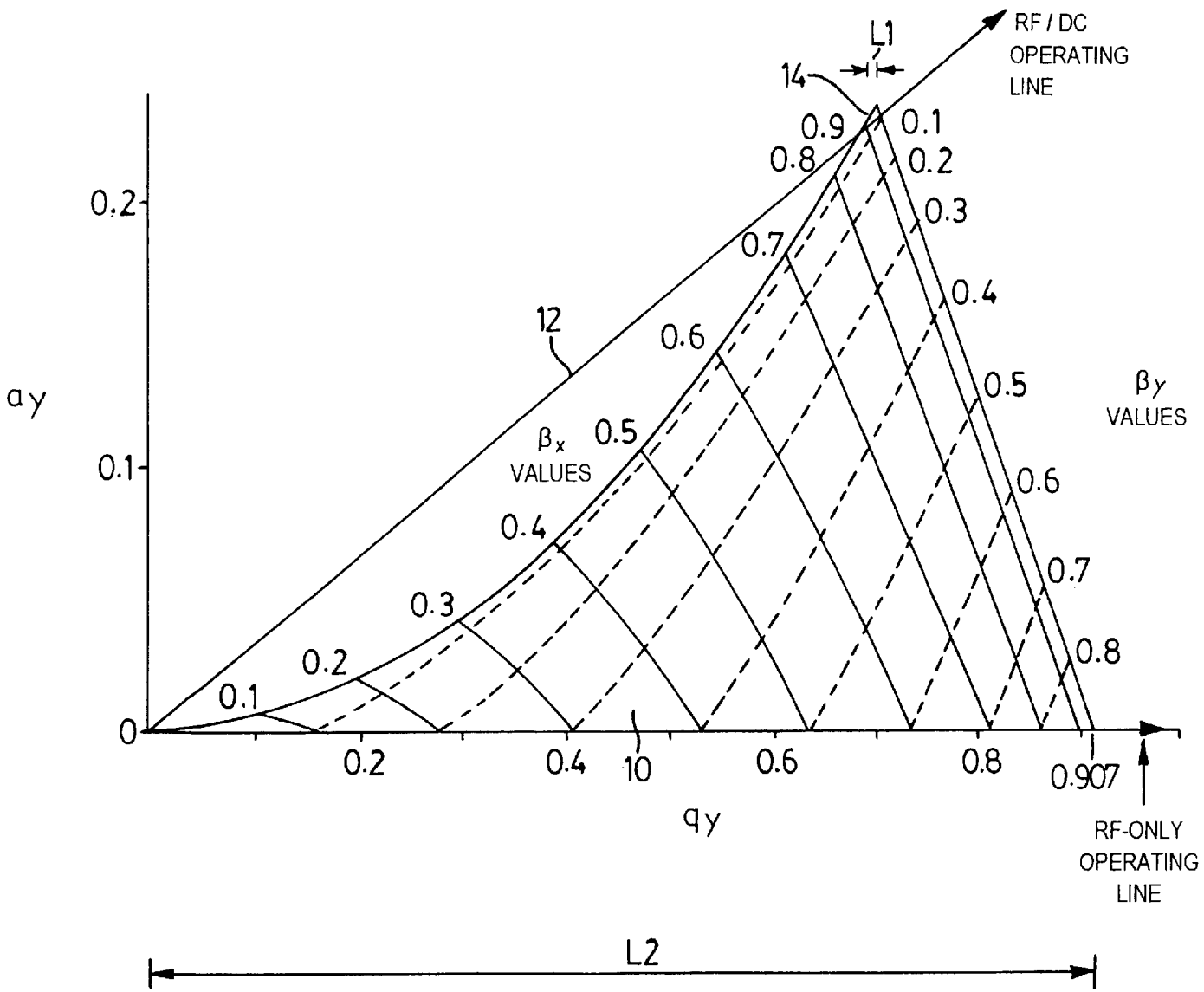
FIG. 1 is a plot of the well-known a-q operating diagram for quadrupole mass spectrometers.

Reference is first made to FIG. 1, which shows the well-known operating diagram for a quadrupole mass spectrometer. The parameter a is plotted on the vertical axis while the parameter q is plotted on the horizontal axis. As is well known, $$a=8eU/(m\omega^2 r_0^2)$$

$$q=4eV/(m\omega^2 r_0^2)$$

where U is the amplitude of the DC voltage applied to the rods, V is the RF amplitude, e is the charge on the ion, m is its mass, ω is the RF frequency, and $r_0$ is the inscribed radius of the rod set (as explained for example in U.S. Pat. No. 5,248,875).

In the FIG. 1 operating diagram, ions within the shaded area 10 are stable provided that they are above the operating line 12. The operating line is usually made to run near the tip or peak 14 of the stability diagram, since the resolution of the mass spectrometer is the width L1 of the peak above the operating line divided by the width L2 of the base of the stability diagram. This requires as mentioned that substantial RF and DC voltages be applied to the rods. In addition, to optimize the resolution, the RF/DC ratio must be controlled to within very small limits which are mass dependent, so the ratio of RF/DC must be scanned with mass. If the optimal ratio is not maintained, resolution is severely impaired.

It is known to operate a quadrupole rod set without DC (RF only), in which case the operating line is along the horizontal axis of the stability diagram and the device acts essentially as an ion pipe, transmitting ions over a wide mass to charge ratio (m/z) range. However ions whose q is 0.907 become unstable radially, hit the rods, and are not transmitted.

In the fringing fields at the entrance or exit of the rods, some component of the radial excitation of the ions is converted into axial excitation. Ions subjected to this influence receive a kinetic energy increase in the axial direction, because of radial/axial coupling in the fringing fields. These ions, of q close to 0.907, which have greater kinetic energy than ions having a smaller q, can be separated by virtue of their differences in energy and can then be detected.

Figures 2A, 2B:
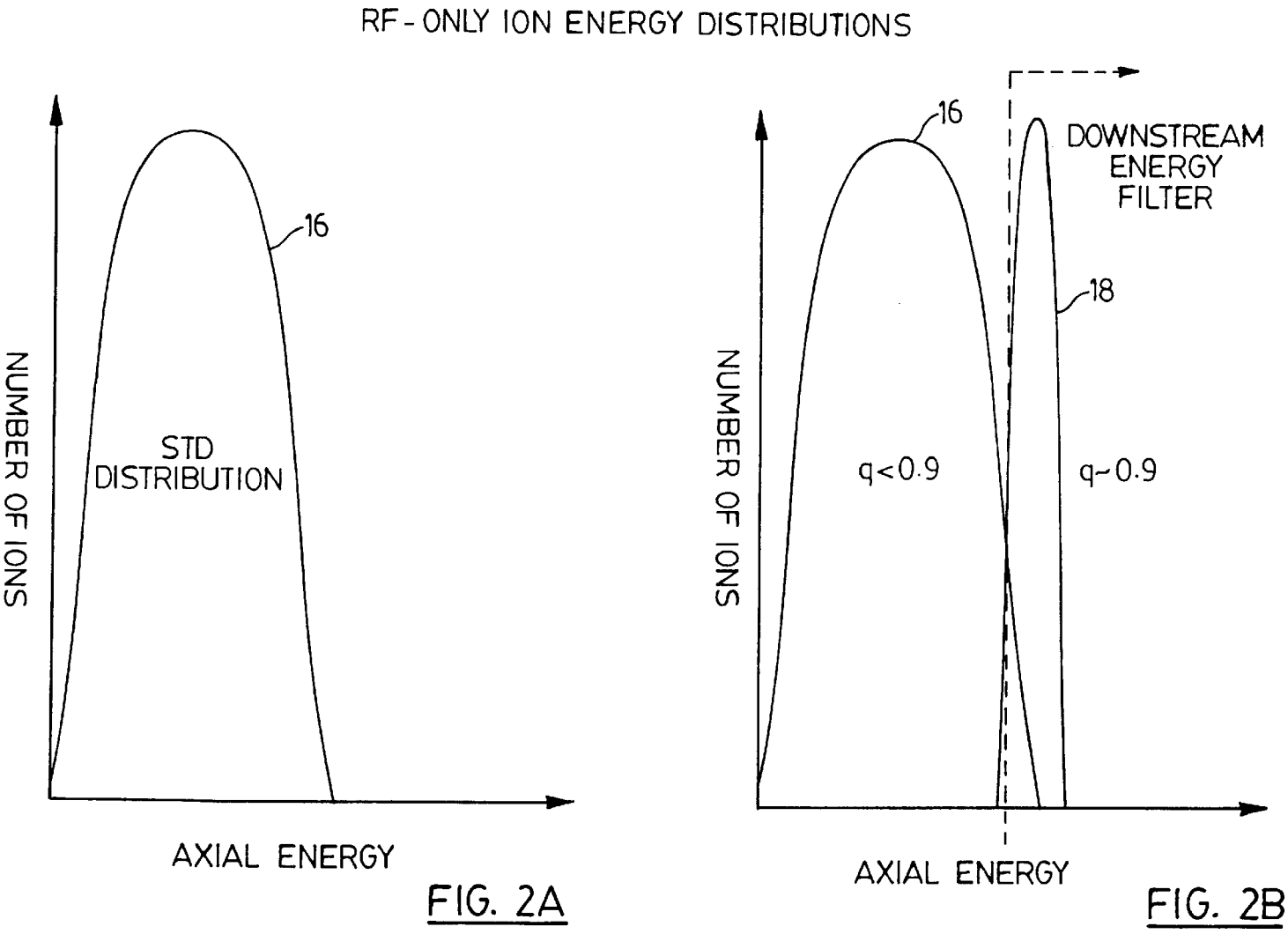
FIG. 2A is a plot showing the distribution of ion axial energies produced by a typical RF-only quadrupole set of rods.
FIG. 2B is a plot similar to FIG. 2A but showing the ion energy distribution after the ions have passed through the fringing fields at the exit end of the RF-only quadrupole rods.

The energy considerations are illustrated in FIGS. 2A and 2B. FIG. 2A shows at 16 the standard axial energy distribution of ions travelling into an RF only quadrupole rod set, plotted against the number of ions. The width of curve 16 will depend on the energy spread of the ions entering the quadrupole rod set; this energy spread can be made relatively narrow as will be discussed.

FIG. 2B shows curve 16 from FIG. 2A and also shows curve 18 representing the distribution of axial energies of ions whose q is about 0.9 and which have therefore received additional axial energy coupled from the fringing fields. If there is a sufficient separation between curves 16, 18, then the ions having the energies represented by curve 18 can be separated from the remaining ions, e.g., by a downstream energy filter, and can be detected. A mass spectrum can be obtained in this way, by scanning the RF voltage applied to the quadrupole rods to bring the q of ions of various masses to near 0.907, at which time the large radial energies which they acquire yield increased axial energies, so that these ions can be separated.

Figure 3A:
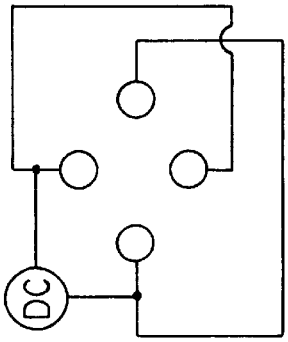
FIG. 3A (PRIOR ART)
FIG. 3A is an end view showing how DC is conventionally applied to quadrupole rods.
Figure 3:
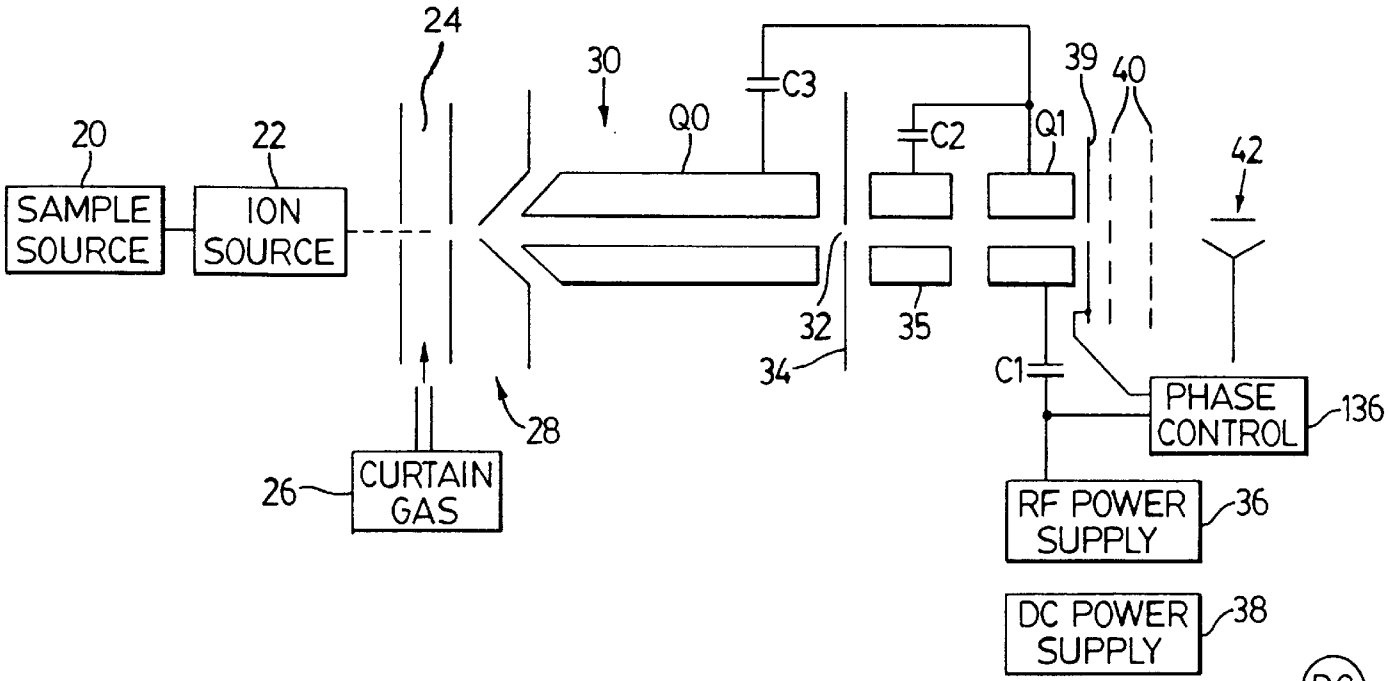
FIG. 3 is a diagrammatic view showing an RF-only single MS configuration.
Figure 4A:
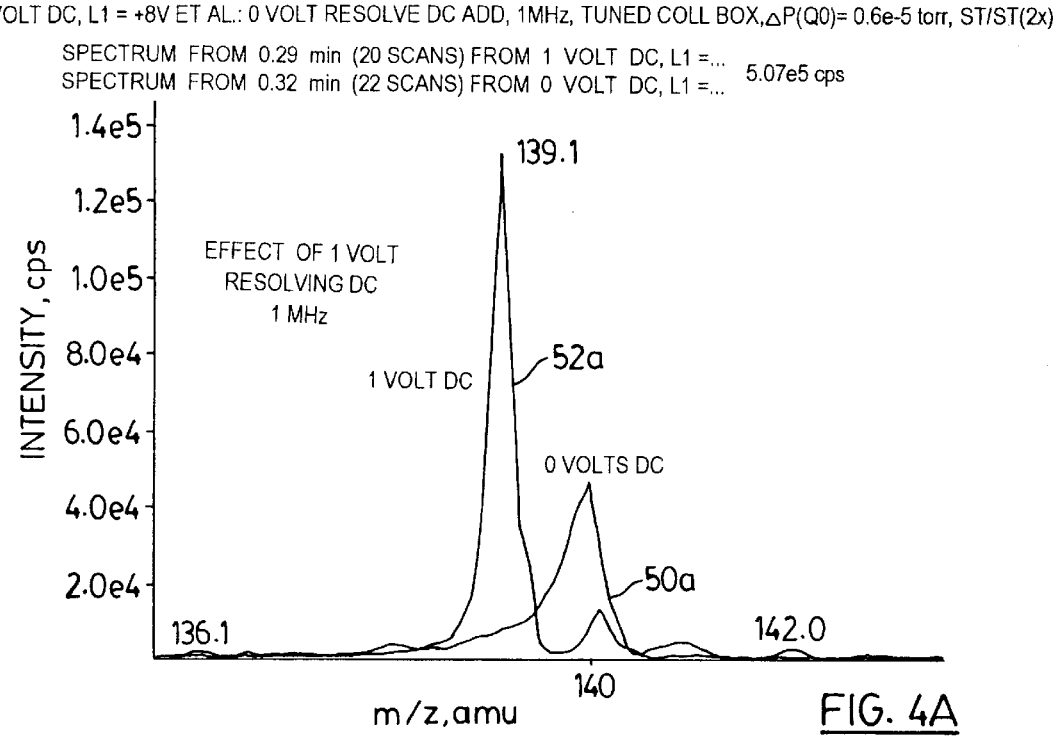
FIGS. 4A to 4D are plots showing mass spectra obtained from the FIG. 3 apparatus, both with 0 volts DC on the resolving rods and with 1 volt DC on the resolving rods.
Figure 4B:
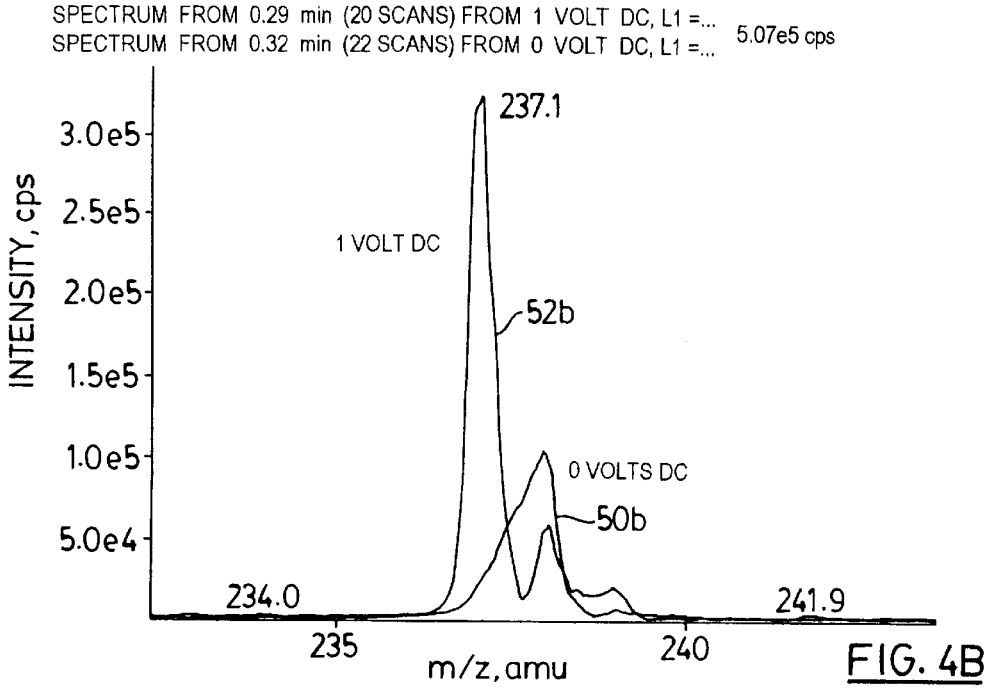
Figure 4C:
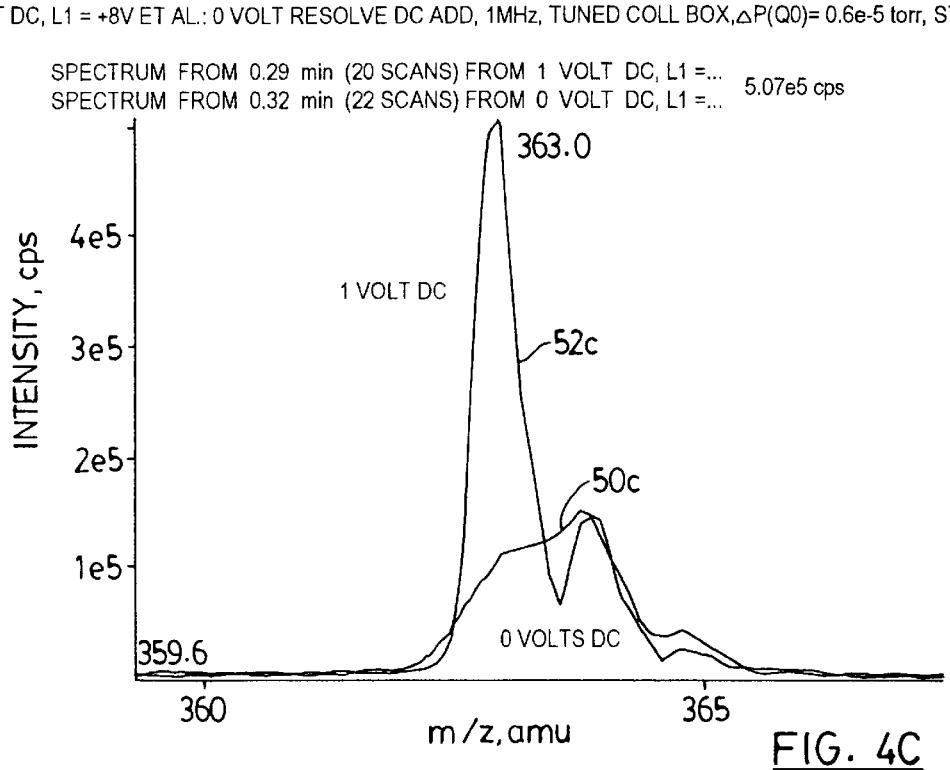
Figure 4D:
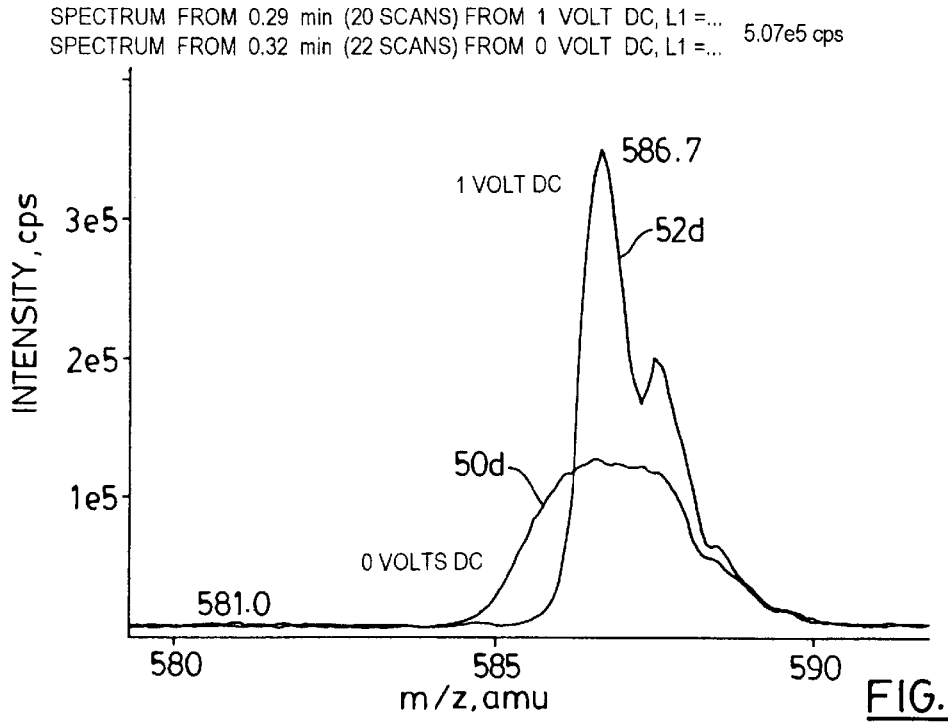

FIG. 3 illustrates apparatus which may be used for obtaining a mass spectrum in the above described way. As shown, sample source 20 (which may be a liquid or gaseous ion source) supplies sample to an ion source 22 which produces ions therefrom and directs them into an interface region 24 which may be supplied with inert curtain gas 26 (usually argon or nitrogen) as shown in U.S. Pat. No. 4,137,750. Ions passing through the gas curtain travel through a differentially pumped region 28, at a pressure of about 2 Torr, and enter a quadrupole RF-only rod set Q0 in chamber 30, which is pumped to a pressure of about 8 milli-Torr. Rod set Q0, which is conventional, serves to transmit the ions onward with removal of some gas. In addition, Q0, because of the relatively high pressure therein also serves to collisionally damp or cool the ions to reduce their energy spread, as described in U.S. Pat. No. 4,963,736.

From chamber 30, the ions travel through orifice 32 in an interface plate 34, and through a set of short RF-only rods 35 into a set of analyzing rods Q1. RF rods 35 serve to collimate the ions travelling into analyzing quadrupole rods Q1.

The rods of Q0 may typically be about 20 cm long, while the rods 35 and Q1 may typically each be approximately 24 mm or 48 mm in length. Analyzing rods Q1 are supplied with RF through capacitor C1 from power supply 36. The same RF is supplied through capacitors C2, C3 to rods Q0, 35. Conventional DC offsets are also applied to the various rods and to the interface plates from a DC power supply 38.

A conventional exit lens 39 and energy filter 40 (consisting of a pair of grids) are located downstream of the analyzing rods Q1, in the ion path, followed by a conventional detector 42.

The apparatus described above is relatively conventional (except for the shortness of the rods Q1), and can produce a mass spectrum as the RF on analyzing rods Q1 is scanned. As mentioned, ions approaching a q of 0.907 receive additional axial kinetic energy coupled from their radial energy in the fringing fields at the entrance and exit ends of the analyzing rods Q1 and are able to surmount the potential barrier created by the energy filter 40 and can reach the detector 42. However a problem with this arrangement is that the resolution is very poor, and in addition the sensitivity is approximately five times less than with conventional mass spectrometers in which both AC and DC are applied to the resolving rods. It is believed that the reduction in sensitivity is caused because in order for the energy filter 40 to eliminate ions which cause peak broadening, at the same time many ions of significance must also be discarded.

It has been found, unexpectedly, that applying a small amount of DC to the analyzing rods Q1 produces (when certain RF conditions exist, as will be described) a dramatic increase in performance, far beyond that which would normally be expected. Reference is next made to FIGS. 4A to 4D, which show portions of mass spectra of a mixture of four substances at four different mass peaks. The substances were tetraethyl ammonium hydroxide (ions at m/z 130), dodecyl trimethyl ammonium bromide (ions at m/z 228), tetrahexyl ammonium hydroxide (ions at m/z 354), and tetradecyl ammonium bromide (ions at m/z 578). Curves

50*a*, 50*b*, 50*c*, 50*d* show the peaks obtained when the resolving rods Q1 are operated in conventional RF-only mode (no DC applied). Peaks 52*a*, 52*b*, 52*c*, 52*d* show the results obtained when one volt DC was applied to the resolving rods Q1. (The DC was applied in the same manner as high voltage resolving DC is normally applied, namely between opposite pairs of rods, as shown for source "DC" in FIG. 3A.) It will be seen that both the resolution and the sensitivity have increased dramatically. Indeed the resolution has improved sufficiently to see isotopic peaks 52*b*, 52*d* when a single volt of resolving DC is applied. The sensitivity has improved by a factor of about 4, which brings it close to that of a conventional instrument but with far less cost and much simpler optimization, as will be explained.

It will be seen in FIGS. 4A to 4D that the peaks 52*a* to 52*d* obtained with the use of 1 volt DC are mass shifted from the peaks 50*a* to 50*d* obtained when 0 volts DC were applied. This is simply because the calibration is determined by both the RF and DC levels and had not been reset on the instrument.

Figure 5:
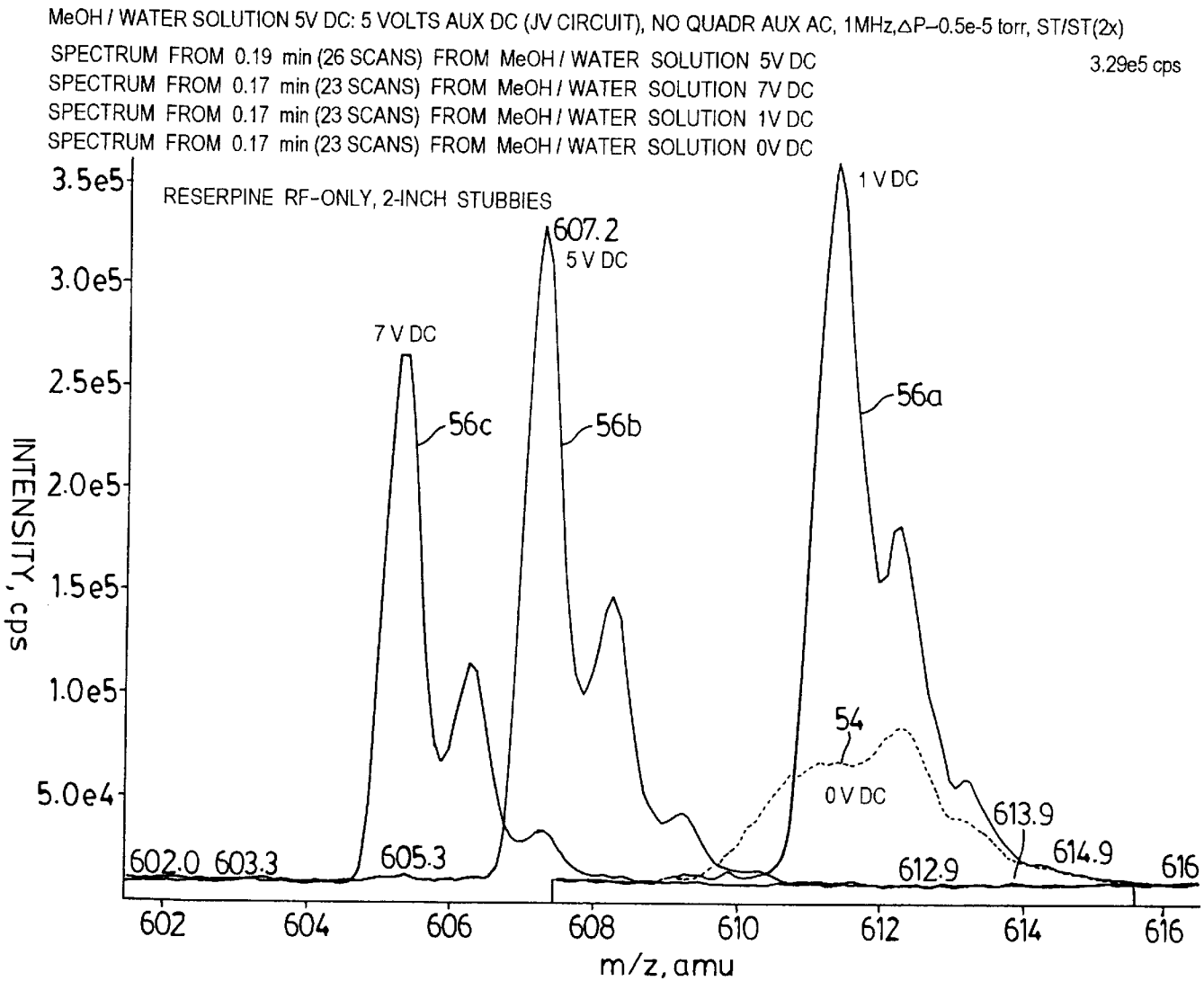
FIG. 5 shows another set of mass spectra obtained using the apparatus of FIG. 3, with 0 volts DC and with various low level DC voltages applied to the resolving rods.

FIG. 5 shows mass spectra obtained from reserpine solution, with m/z approximately equal to 609. Q1 was constructed employing two-inch long rods. Curve 54 shows the spectrum obtained when 0 volts DC were applied to the rods Q1 (which were therefore operated with RF only). Curve 56*a* shows the spectrum obtained when 1 volt DC was added to the rods Q1. Curves 56*b*, 56*c* show the same spectra when 5 volts and 7 volts DC respectively were applied to rods Q1. It will be seen that as the DC voltage increases, the resolution increases but the sensitivity falls to some extent.

Figure 6:
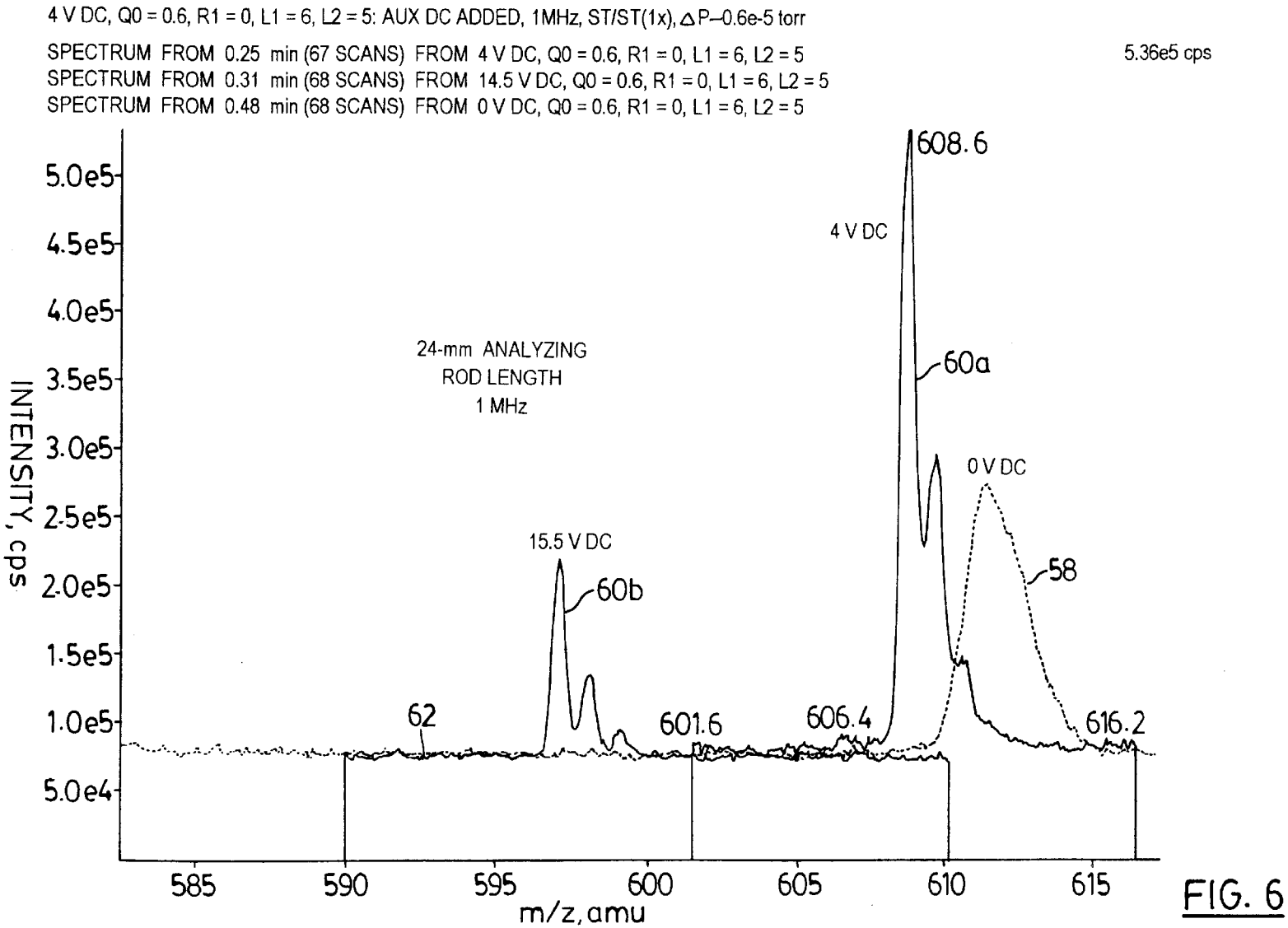
FIG. 6 is still another view of mass spectra obtained from the FIG. 3 apparatus, showing results obtained with 0 volts DC and with 4 volts and 15.5 volts DC applied to the resolving rods.

FIG. 6 shows a mass spectrum obtained for reserpine with Q1 constructed from 24 mm long rods. Curve 58 shows the spectrum obtained when 0 volts DC were applied to the rods Q1, while curves 60*a* and 60*b* show the spectra obtained when 4 volts and 15.5 volts DC respectively were applied to the rods Q1. The background noise is indicated at 62. Again it will be seen that the resolution increases substantially as the DC voltage is increased, but that the sensitivity is considerably less at 15.5 volts DC than at 4 volts DC.

While the rod length is important for a conventional resolving quadrupole mass spectrometer, in which both AC and DC are applied to the rods, rod length is not particularly important with the use of the invention. Relatively short rods will do, as will be explained.

The precise amount of DC applied to the rods can vary, as indicated. Experiments indicate that DC in the range of 0.1% to 40% of the normal DC voltage (which may as mentioned typically be 272 volts peak-to-peak at 600 amu) may be used on the analyzing rods when the rods are operating near the tip 14 of the a-q diagram of FIG. 1. A range of between 0.3 and 15.5 volts DC is preferred, and preferably a range of between 1 and 15.5 volts DC is used (since 1 volt produces improved results as compared with 0.3 volts). However, good results were obtained at a DC voltage of up to 40% of the usual DC voltage, or about 109 volts DC. Above that level, both the peak shape degrades and the sensitivity drops off, both relatively sharply.

Figure 7:
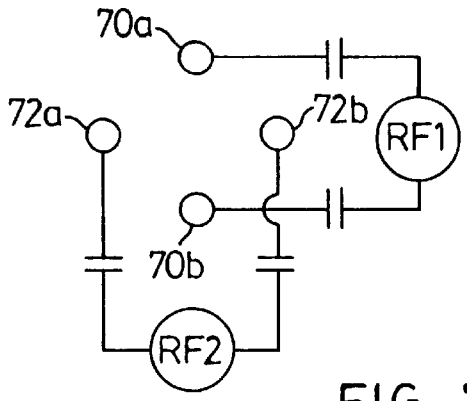
FIG. 7 is an end view showing how AC is applied to the rods according to the invention.

It is also found that in the embodiment described, the RF applied to the rods should be unbalanced and desirably is between 5% and 30% out of balance (for reasons which will be explained). The exact amount of out of balance is a matter of optimization in each case. As shown in FIG. 7, there are normally two RF power supplies, namely power supply RF1 driving one pair of rods 70*a*, 70*b* and power supply RF2 driving the other pair of rods 72*a*, 72*b*. The 0 to peak voltage of power supply RF1 is desirably between 5% and 30% greater than that of power supply RF2 (or vice versa), i.e. the unbalance is desirably 5% to 30% from 0 to peak or 20% to 60% peak to peak. The drawings provided were achieved with the use of unbalanced RF.

Use of the invention has extremely significant advantages in terms of cost and ease of use. In a conventional mass spectrometer using analyzing rods which have AC and DC applied to them, the rods must typically be 20 cm or more in length, metallized ceramic, with roundness tolerances better than 20 micro-inches and straightness tolerances better than 100 micro-inches. Such rods may typically cost $600 each and typically take 240 minutes to assemble. With the use of the invention, much shorter rods can be used, e.g., 2.4 cm metal tubes, with roundness tolerances of ±2/1000 of an inch and straightness tolerances ±2/1000 of an inch. Such rods typically cost $7.00 each (compared with $600 each for conventional rods) and can be assembled in about five minutes (compared with 240 minutes for conventional rods). In addition, since no high voltage DC is needed, the electronics are much simpler and cheaper. Since the DC does not need to be scanned in conjunction with the RF scanning, this additionally simplifies the electronics. (However, if desired the DC can be scanned for other reasons.) Further, the system described can operate at higher pressure ($10^{-4}$ Torr, as compared with at least $10^{-5}$ Torr or better for conventional rods), resulting in smaller and less costly vacuum pump requirements. In addition, the instrument is much easier to use since only the RF need be scanned; there is no need to scan the ratio of RF to DC, since resolution is not achieved by adjusting the RF/DC ratio, but instead by adjusting the downstream energy filter.

Figure 8:
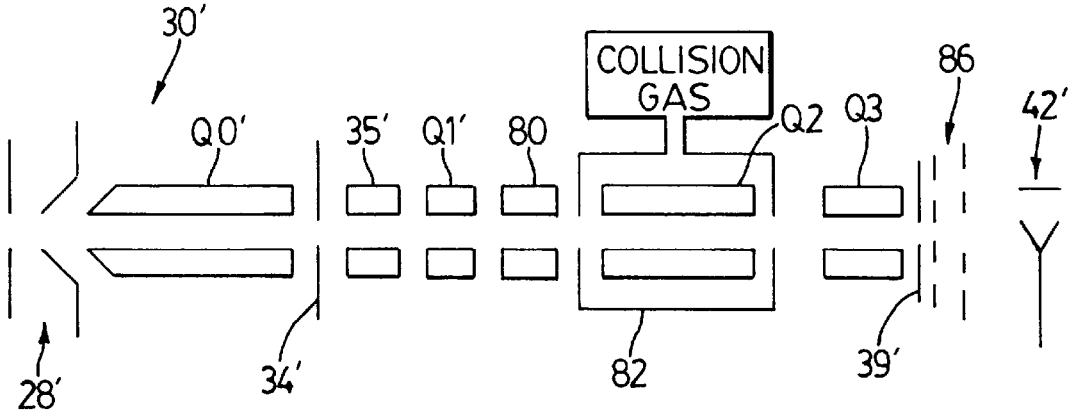
FIG. 8 is a diagrammatic view showing the configuration used for MS/MS analysis according to the invention.

While FIG. 3 shows single MS operation, the instrument described may also be used for MS/MS operation, as shown in FIG. 8, where parts corresponding with those of FIG. 1 are marked with primed reference numerals. In FIG. 8, the ions travel through rod sets Q0', 35', and Q1' as before. The ions then travel through a short set of RF only rods 80 which collimate them into a collision cell Q2. The rod offset of RF-only rods 80 is held at 2 to 10 volts more positive than that of rods Q1, creating a voltage barrier which also serves as the energy filter 40.

In rod set Q2, located in container 82, collision gas from source 84 is provided. Hence parent ions entering Q2 are fragmented in conventional manner into daughter ions. The daughter ions are directed through analyzing rods Q3 to which RF and the previously described low level DC are applied, and then through energy filter 86 to a detector 42'.

Figure 9:
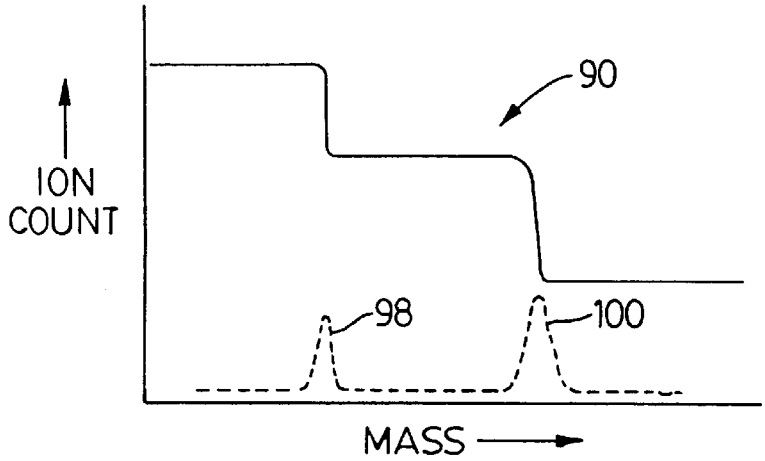
FIG. 9 shows a spectrum obtained according to the invention without energy filtering.

While energy filtering provides a simple method of extracting peaks, other methods may be used if desired. Without energy filtering, a "stair step" spectrum is obtained, as shown at 90 in FIG. 9, with different masses represented by different levels 92, 94, 96 in spectrum 90. Mass peaks can be obtained by differentiating the curve 90, as shown in dotted lines at 98, 100 in FIG. 9. However, this method is not preferred, since with the use of this method, the detector 42 receives a larger and more continuous flux of ions and is therefore more likely to burn out.

The theory of operation of the invention as it is best understood (and in particular the reasons for the need for unbalanced RF or its equivalent, and the reasons for the applicability of the low voltage DC), and additional embodiments of the invention, will now be discussed.

Figure 10:
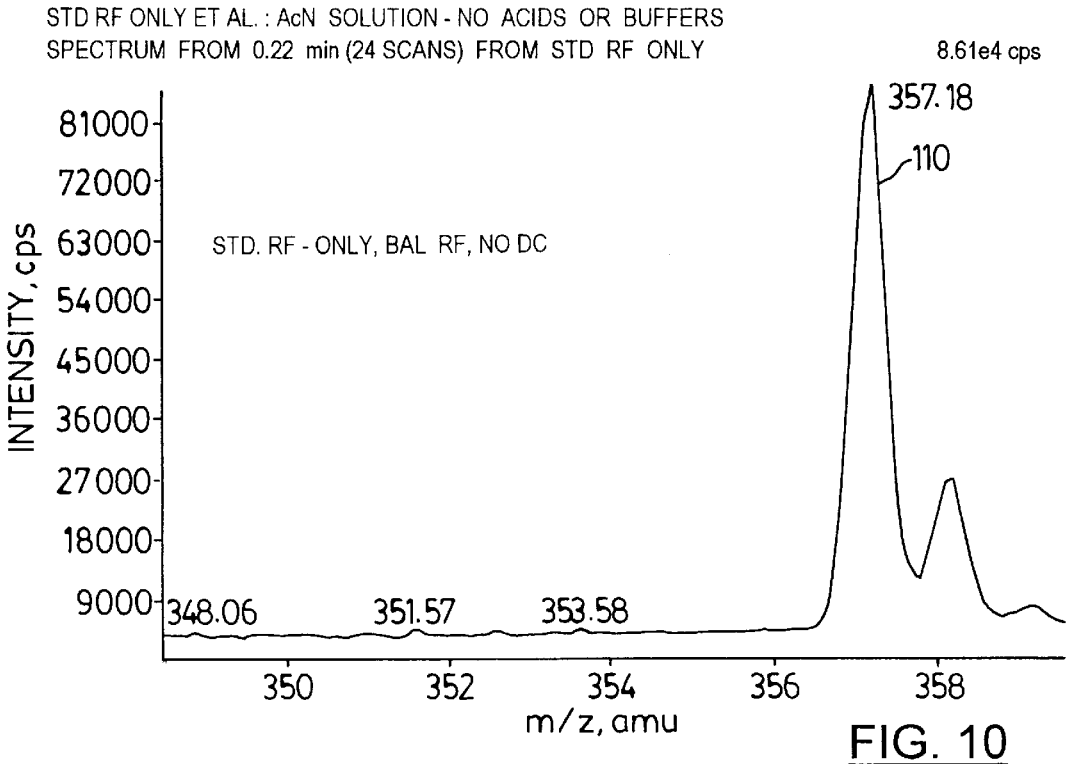
FIG. 10 shows a mass spectrum obtained using standard balanced RF without DC.

Reference is made to FIG. 10, which shows a spectrum from a conventional set of analyzing rods, such as Q1 in FIG. 3, with standard balanced RF applied, and no DC. A peak 110 appears at mass 357.18, out of intensity 8.61e4 ($8.61\times10^4$ counts per second (cps)). (AcN solution was used as a solvent, with no acids or buffers, with the same mixture of substances as described in connection with FIG. 4.)

Figure 11:
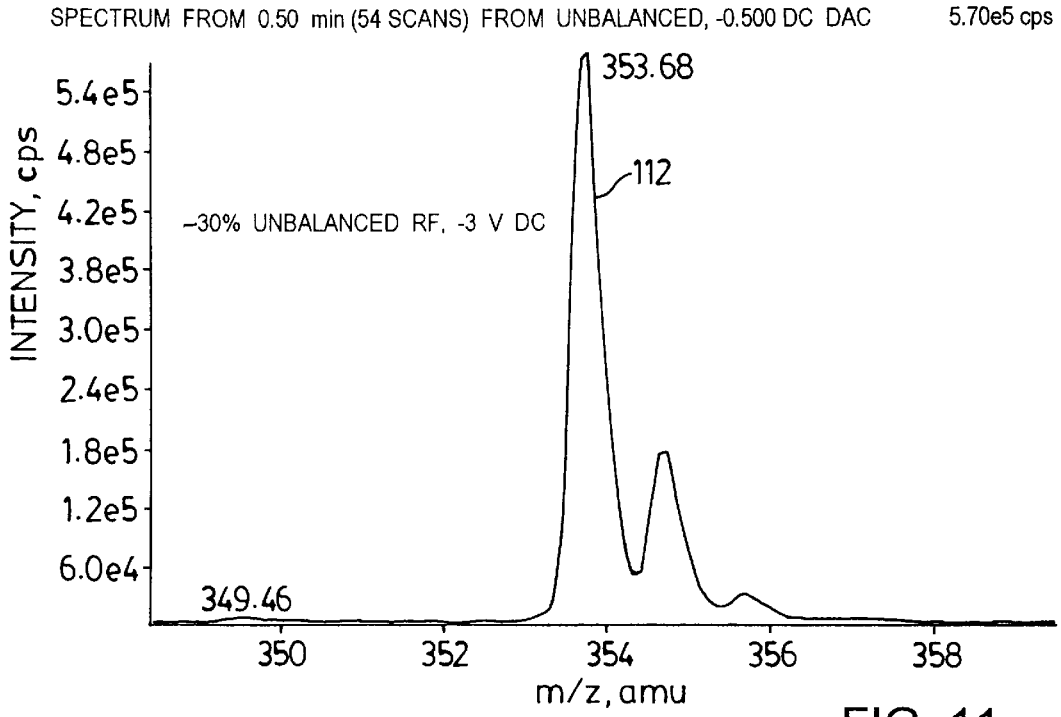
FIG. 11 shows a spectrum for the same substance as that of FIG. 10, but obtained using unbalanced RF and low voltage DC.

FIG. 11 shows a spectrum obtained from the same rods Q1 with the same solution as for FIG. 10, when the RF was unbalanced by 30% and ±3 volts DC was applied across respective pairs of rods. The resulting peak 112 corresponds to peak 110 but has been shifted (this is simply a matter of calibration), but the intensity has increased in intensity to 5.70 e5 cps, or approximately seven times the intensity of peak 110.

Figure 12:
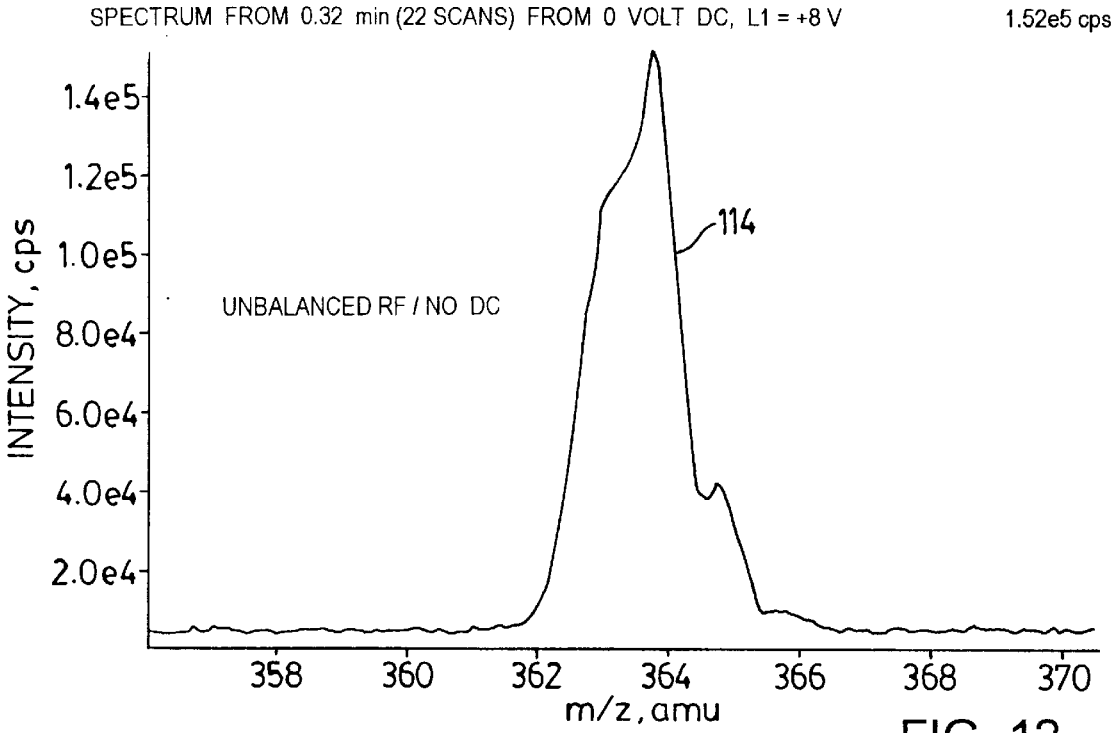
FIG. 12 shows a spectrum obtained using unbalanced RF but no DC.

FIG. 12 shows another spectrum from rods Q1, using the same solution as for FIG. 11, with unbalanced RF on the rods (the unbalance was approximately 20%), but not using DC. It will be seen that peak 114 has poor shape and low intensity (the intensity is 1.52e5 cps). It is generally observed that operating the short analyzing quadrupole with unbalanced RF in the absence of resolving DC results in poor peak shape such as peak 114 (except as will be discussed later).

Figure 13:
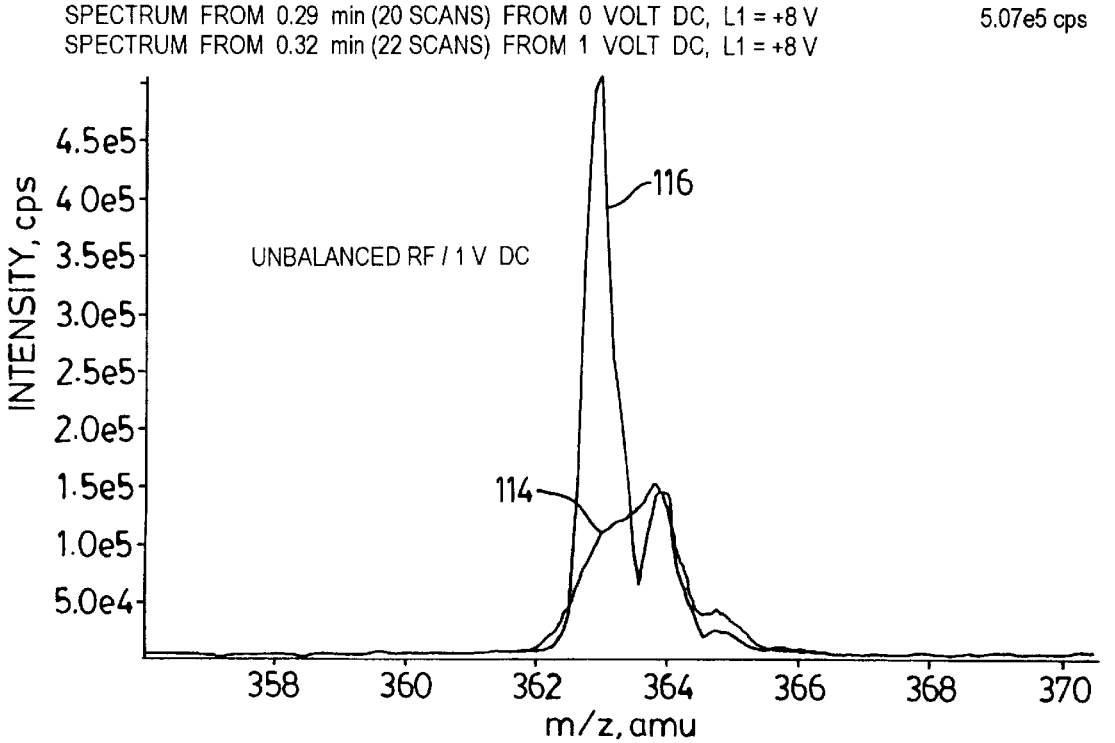
FIG. 13 shows a spectrum for the same substance as that of FIG. 12, but using unbalanced RF with low voltage DC (and with the spectrum of FIG. 12 superimposed thereon)

FIG. 13 shows a spectrum similar to that in FIG. 12 (using the same solution), but obtained by using 1 volt DC applied across respective pairs of rods, in addition to the unbalanced RF. The resultant peak 116 had a much narrower (and therefore better) shape and an intensity of 5.07e5 cps. For comparison purposes the peak 114 of FIG. 12 is shown in dotted lines in FIG. 13, so that the improvement by using both unbalanced RF and a low voltage DC can be seen.

The conclusion from the above experiments was that neither unbalanced RF alone, nor low voltage DC with balanced RF, is sufficient. A combination of both, or their equivalents (to be discussed), is needed for best results.

Figure 14:
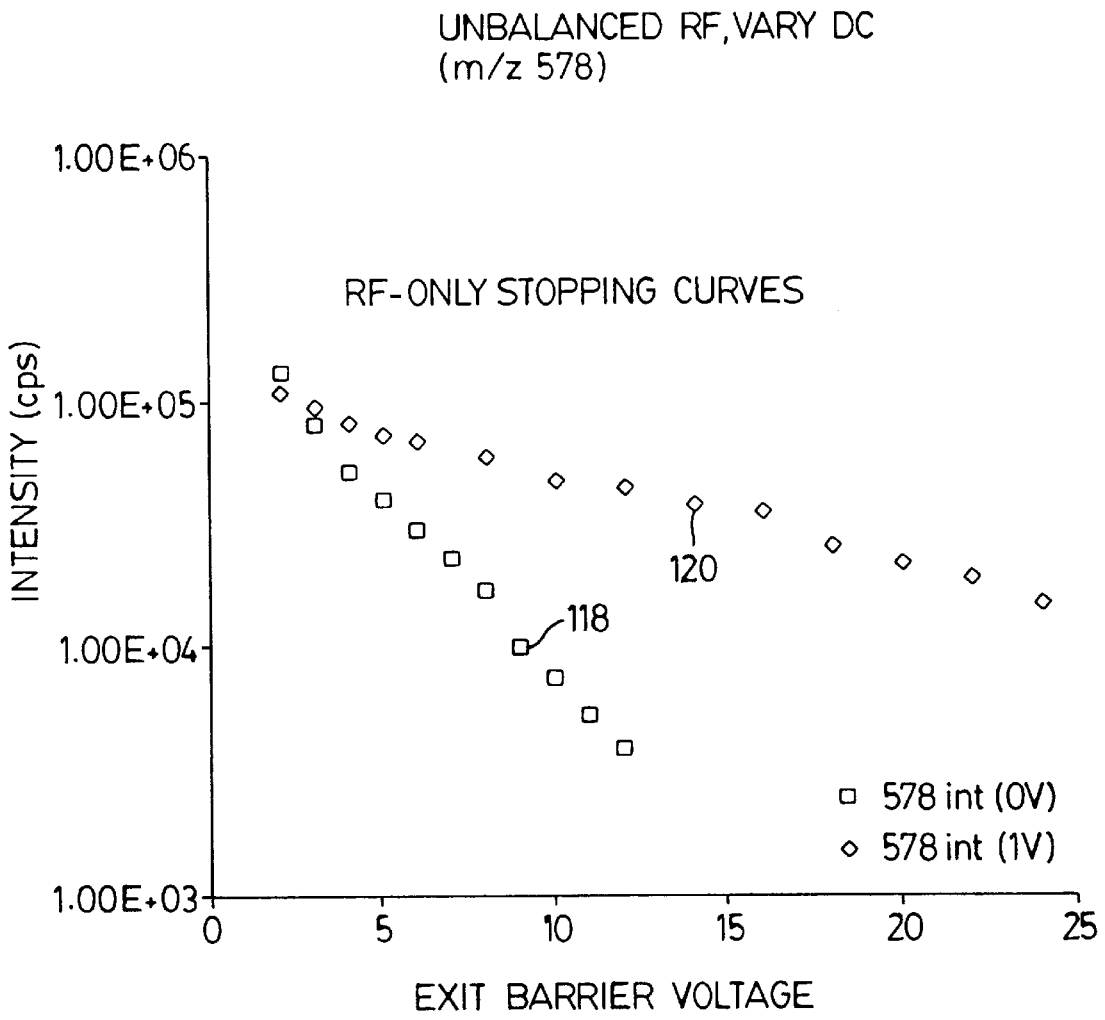
FIG. 14 is a plot showing stopping curves obtained with unbalanced RF and with 0 volts DC and low voltage DC.
Figure 15:
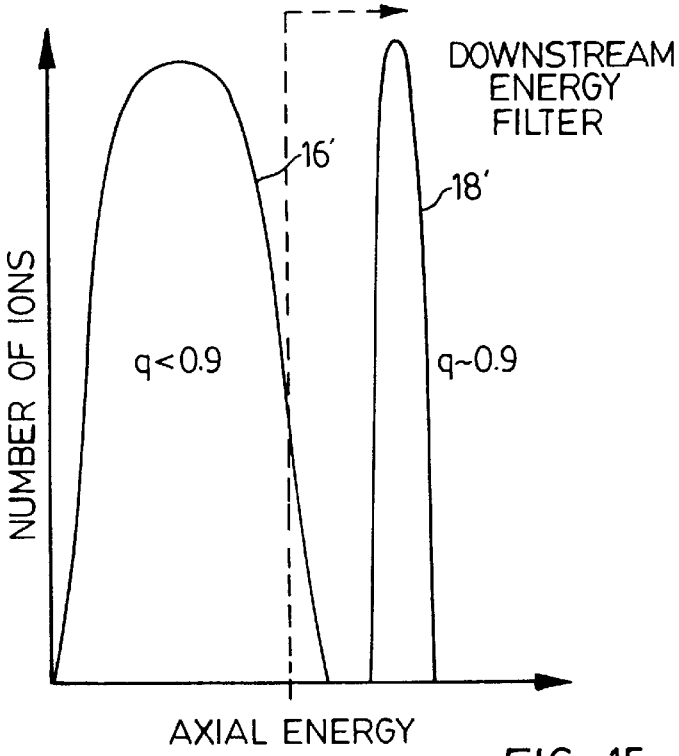
FIG. 15 is a plot similar to that of FIGS. 2A, 2B but showing increased displacement between the ion energy distributions resulting from the use of the invention.

To help assess the reasons for this, stopping curves were produced as shown in FIG. 14. To produce FIG. 14, a barrier DC voltage (plotted on the x-axis of FIG. 14) was applied to the exit lens 39 following Q1, and the intensity (cps) of ions able to pass the exit barrier was plotted on the vertical axis. Curve 118 was produced with the use of unbalanced RF, and 0 volts DC applied to the rods of Q1, while curve 120 was produced with the use of unbalanced RF and 1 volt DC applied to the rods of Q1. It will be seen that when the lens was operated at (for example) 10 volts, there was an increase of about 5.7 times in the intensity of ions able to pass the barrier when both unbalanced RF and low voltage DC were present. It is evident from this that when both unbalanced RF and a low voltage DC are applied, the ions of interest have greater kinetic energy so that more of them are able to pass the barrier created by the biased exist lens 39. The difference in energy distributions is illustrated in FIG. 15, which is the same as FIG. 2*b* and in which primed reference numerals are used to indicate corresponding elements. As will be seen, the curve 18' of ions having a q of about 0.9 is displaced to a higher energy than was the case in FIG. 2*b* and is better separated from curve 16' representing ions having a q of less than 0.9. Separation of the respective sets of ions by a downstream energy filter such as filter 40 can therefore more easily be achieved (i.e., low q ions are more efficiently prevented from reaching the detector).

Figure 16:
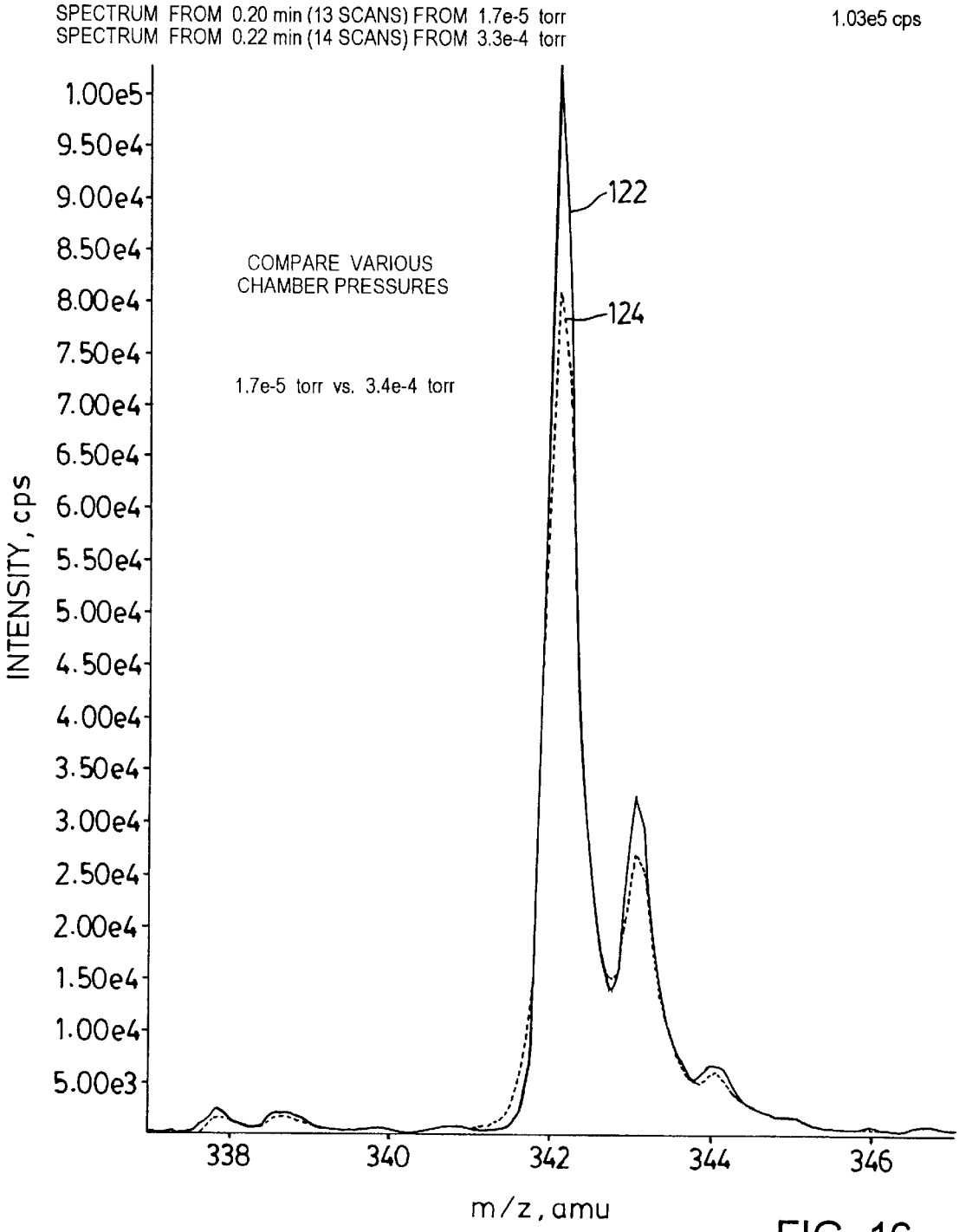
FIG. 16 shows two spectra obtained with the use of the invention at two different pressures.

FIG. 16 is an overlay of two spectra 122, 124, taken at different pressures in the chamber containing Q1. Spectrum 122 was made at a pressure of 1.7e-5 torr), while spectrum 124 was made at a pressure of 3.4e-4 torr or about 20 times higher than the pressure for spectrum 122. It will be seen that the peak shapes are virtually the same, and that there is little difference in intensity. Since higher pressure operation is therefore possible, cheaper and less bulky vacuum pumps can be used.

Figure 17:
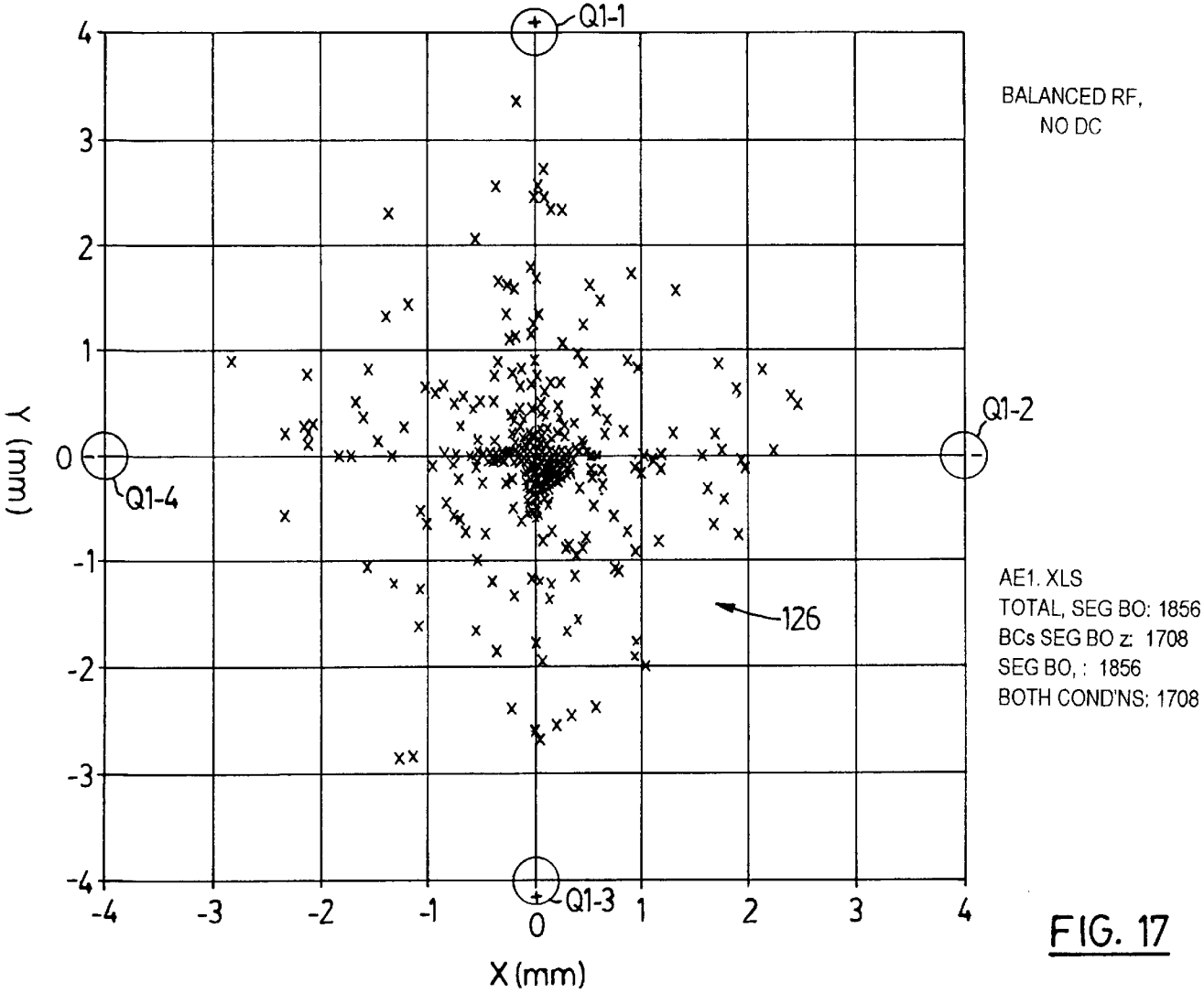
FIG. 17 is a computer simulation showing an end view for rods of FIG. 3, and showing the ion distribution at the ends of the rods when balanced RF and no DC is applied.
Figure 18:
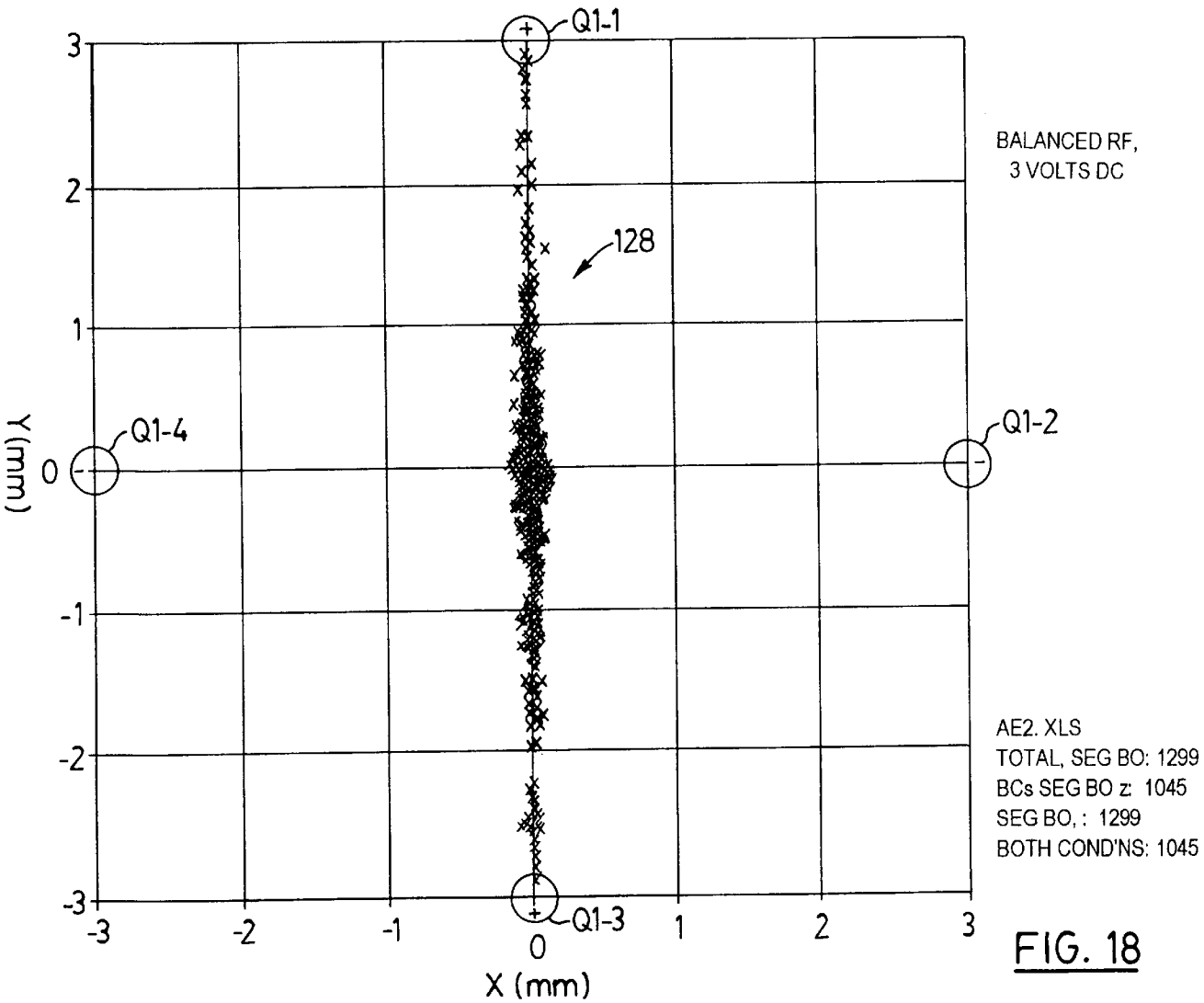
FIG. 18 is a view similar to that of FIG. 17 but showing the ion distribution when low voltage DC is also applied to the rods.

FIGS. 17, 18 help to explain the reasons (as best understood) for the operation of the invention. FIG. 17 is an end-on view (looking towards the exit ends of rods Q1) showing a computer simulation of the distribution of the ions as they exit from the rods (marked as Q1-1, Q1-2, Q1-3, Q1-4), assuming that balanced RF is applied and that no DC is applied. It will be seen that the ions exit in a "cross" pattern 126, symmetrically about the pole pairs of the rods.

FIG. 18 shows a plot similar to that of FIG. 17, but with 3 volts DC applied to the rods Q1. The positive rods are the y-axis rods Q1-1, Q1-3, while the negative rods are the x-axis rods Q1-2, Q1-4. It will be seen that the ions (which are assumed to be positive) become aligned with the positive pole pair Q1-1, Q1-3 as indicated at 128. The appearance of FIG. 18 would be similar if standard DC (i.e., at a much higher voltage, e.g., 272 volts) were applied, but there would be far fewer ions since in that case the rods Q1 would have a very narrow band pass. However simply to align the ion beam with a pole pair, which is the desired objective here, only a low voltage DC, typically as low as 1 volt, and even as low as 0.3 volts, is needed. The FIG. 18 simulation assumes that a very small diameter collimated ion beam has entered the rods Q1, typically less than approximately 0.1 mm diameter.

Figure 18A:
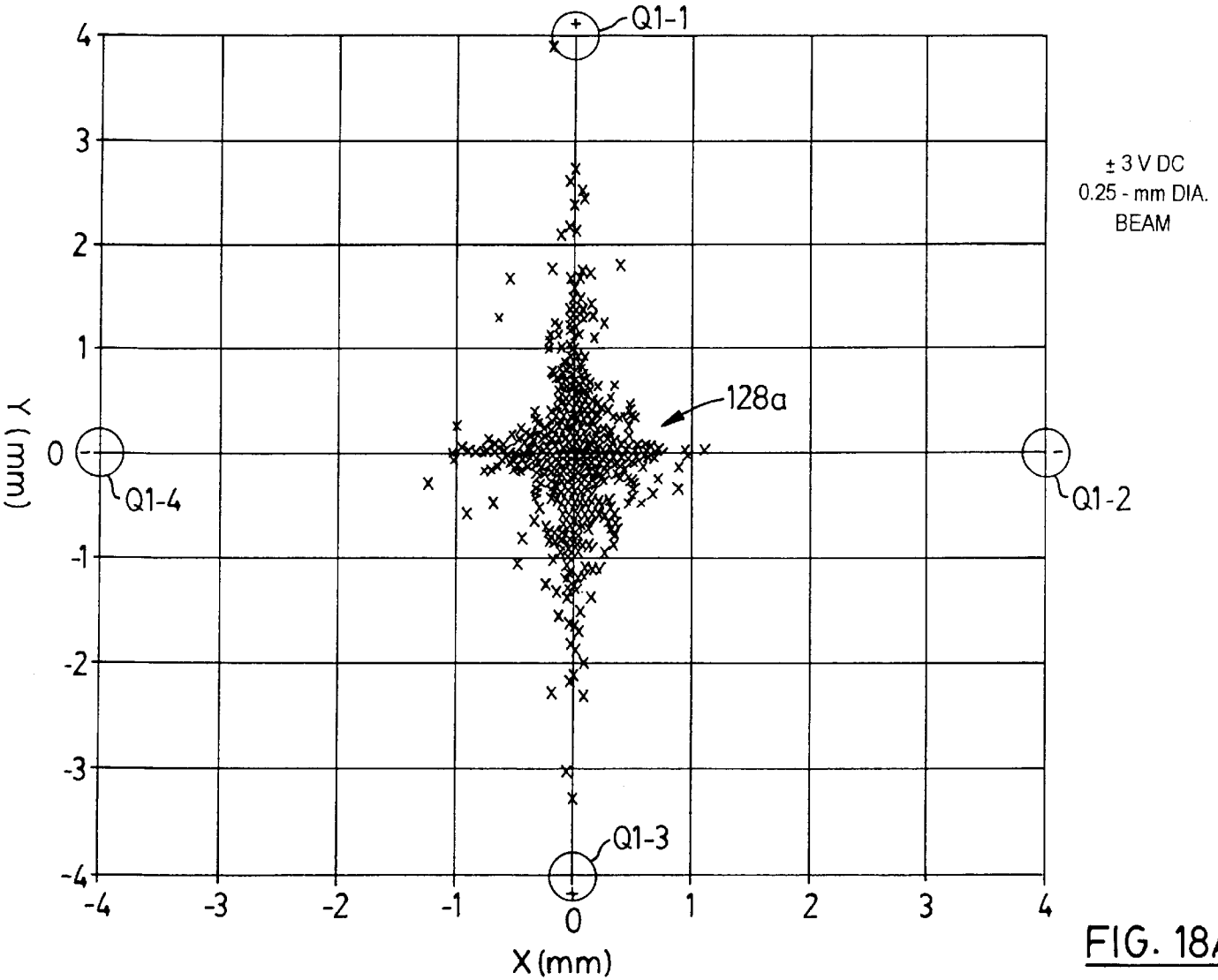
FIG. 18A is a view similar to that of FIG. 18 but showing the ion distribution when a larger diameter ion beam enters the rods.

If the ion beam entering the rods Q1 is of larger diameter, then if the rods Q1 are short, the ions will become less well aligned with one pole pair, since they do not experience sufficient cycles of the RF before they reach the exit ends of the rods Q1. For example, FIG. 18A shows a plot similar to that of FIG. 18, using +3 volts DC applied to the rods, but with a 0.25 mm diameter ion beam entering the rod set Q1. It will be seen that the ions, indicated at 128a, are less well aligned with pole pair Q1-1–Q1-3. Had the rods been longer than the one inch used in the simulation, the alignment of the ions with pole pair Q1-1–Q1-3 would have been improved.

Figure 18B:
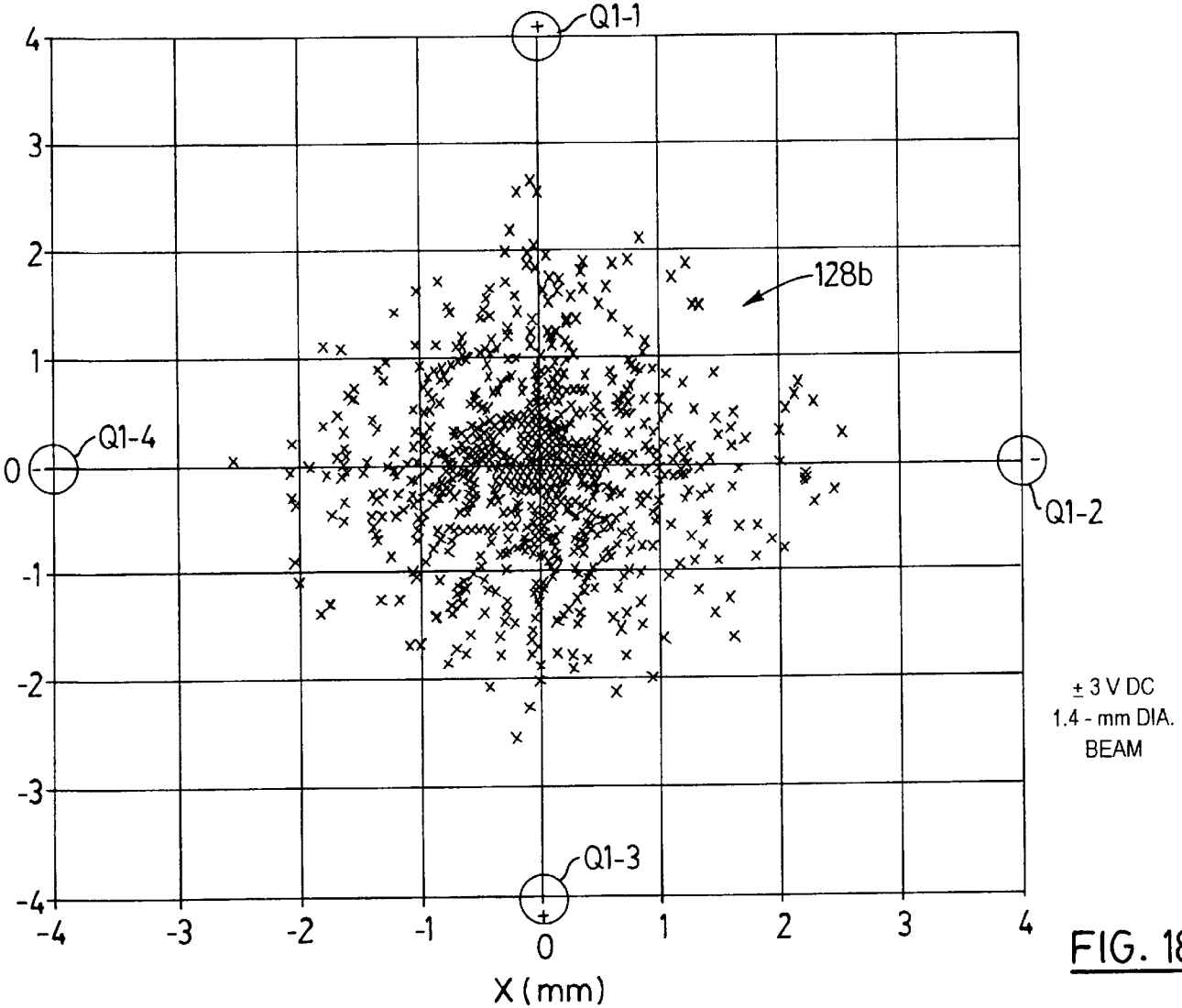
FIG. 18B is a view similar to that of FIG. 18A but showing the ion distribution when an even larger diameter ion beam enters the rods.

Similarly, FIG. 18B shows the ion distribution 128*b* for a 1.4 mm diameter ion beam entering the rod set, with ±3 volts DC applied to the rod set. It will be seen that with a beam of this relatively wide diameter, essentially no alignment with one pole pair is achieved. Again, had the rods been sufficiently long, the ions would have experienced enough cycles of the RF to become aligned with pole pair Q1-1–Q1-3 by the time they reach the exit ends of the rods Q1.

It is known that within the rods Q1, the ions at high q have a secular frequency of radial motion, which frequency is approximately one-half the drive or RF frequency. It is also known that the ions have a smaller motion, referred to as micro motion within the rods, and which is also a radial motion. When the ions enter the fringing field between ends of rods Q1 and the exit lens 39, the motion of the ions becomes complex and no analysis presently exists for their motion, nor is it possible easily to visualize the ion motions. However, it is believed that when the RF is unbalanced, then in one plane, i.e., in a plane through one pair of poles, the field gradient will be different than that in a plane through the other pair of rods. In any event, it has been determined that when the RF field is unbalanced such that the highest RF is on the Q1-2–Q1-4 rod pair (i.e., on the negative DC rods, here defined as the x-rods or x-pole pair), then the ions which are aligned with the Q1-1–Q1-3 pole pair (i.e., the positive DC pole pair, here defined as the y-rods or y-pole pair) receive the additional kinetic energy described, producing much higher sensitivity. (This discussion assumes positive ions. For negative ions the polarities would be reversed.)

Figure 19:
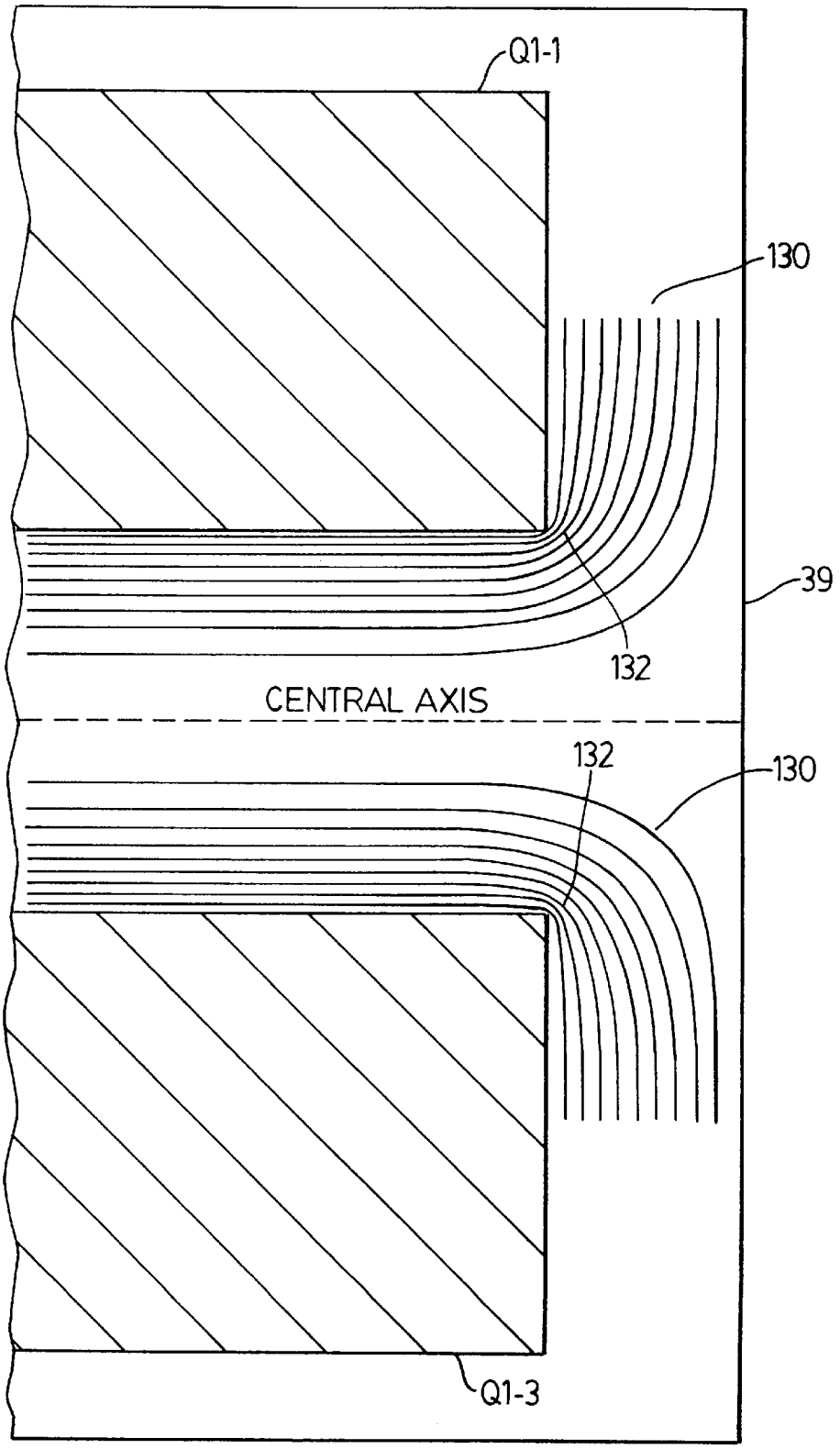
FIG. 19 is a sectional view through two rods and an end lens showing the fringing fields at the exit ends of the rods.

It is believed that the reason for this result is that the ions aligned with the y-pole pair are retarded in the fringing field, i.e., they spend more time in the fringing field between the exit ends of rods Q1 and the exit lens 39, which will enhance the radial to axial coupling. The field lines for a typical fringing field are shown at 130 in FIG. 19. The greater radial excursions bring the ions to positions radially closer to the rods Q1, where the axial component of the fringing field is the strongest. (It will be seen that the field lines are closer here, as indicated at 132.) Ions closer to the rods are therefore ejected with greater kinetic energy, as shown by the stopping curve 120 in FIG. 14.

FIGS. 5 and 6 demonstrate that there are additional subtle effects observable by the addition of small amounts of resolving DC to the short analyzing quadrupole. These figures show that increasing amounts of resolving DC lead to enhanced resolution at the expense of sensitivity. This is consistent with a reduction of incoming ion energy with increased resolving DC. It is thought that increases in resolving DC of the appropriate polarity slightly retard the entry of ions into the resolving quadrupole. Such effects have been modeled by Dawson (*Int. J. Mass Spectrom. Ion Phys*. 17 (1975) 423–445) and found to be important for ion entry in the positive DC quadrants of the entrance fringing fields. This phenomenon, in combination with the modified exit fringing fields achieved via unbalanced drive RF or the application of auxiliary RF to the exit lens (to be described later) may contribute to the high exit kinetic energies observed with this device.

Within the rods Q1, the unbalanced RF has no significant effect on the ions and therefore does not interfere with their transmission.

The effect achieved by unbalancing the RF applied to the rods Q1 can also be achieved by tapping the RF voltage from the RF power supply 36 and applying it to the exit lens 39. The RF applied to the exit lens 39 is phase locked to the main RF applied to Q1 and is typically phase adjustable from 0 to 180°, by a control indicated at block 136 in FIG. 3. The RF applied to the exit lens 39 should be in-phase with the RF applied to the pole pair between which the ions are aligned, e.g., rods Q1-1–Q1-3 in FIG. 18.

Applying the RF field to the exit lens 39 in this way has the same effect as unbalancing the RF applied to the rods Q1, in that the suitably phased RF on lens 39 will cause the bulk of the ions exiting the rods Q1 (i.e., those ions aligned with the y-axis rods) to spend more time in the fringing fields at the exit ends of the rods and thus to acquire more axial kinetic energy before they are ejected.

Figure 20:
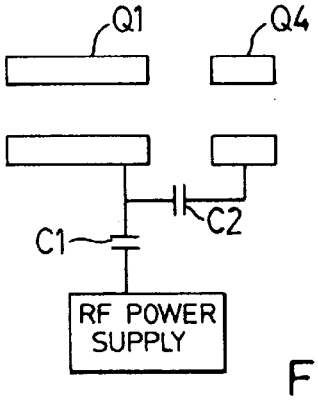
FIG. 20 is a diagrammatic view showing use of an extra set of rods in place of the end lens of FIG. 3.

Instead of a conventional exit lens 39, a set of quadrupole "stubby" (i.e., short) rods Q4 may be used, as shown in FIG. 20. RF can be applied to stubby rods Q4 from the main RF source 36, and the RF on either set of rods Q1, Q4 will be unbalanced appropriately. If desired, rods Q4 can be capacitively coupled to rods Q1 (e.g., by a capacitor indicated at C2), in which case the RF on both sets of rods Q1, Q4 will be unbalanced. Alternatively, instead of applying an unbalanced RF voltage to Q4, all four rods of Q4 can have a phase locked, phase adjustable RF voltage applied thereto (i.e., additional to the drive RF), in which case, Q4 will act similarly to the exit lens 39.

Figure 21:
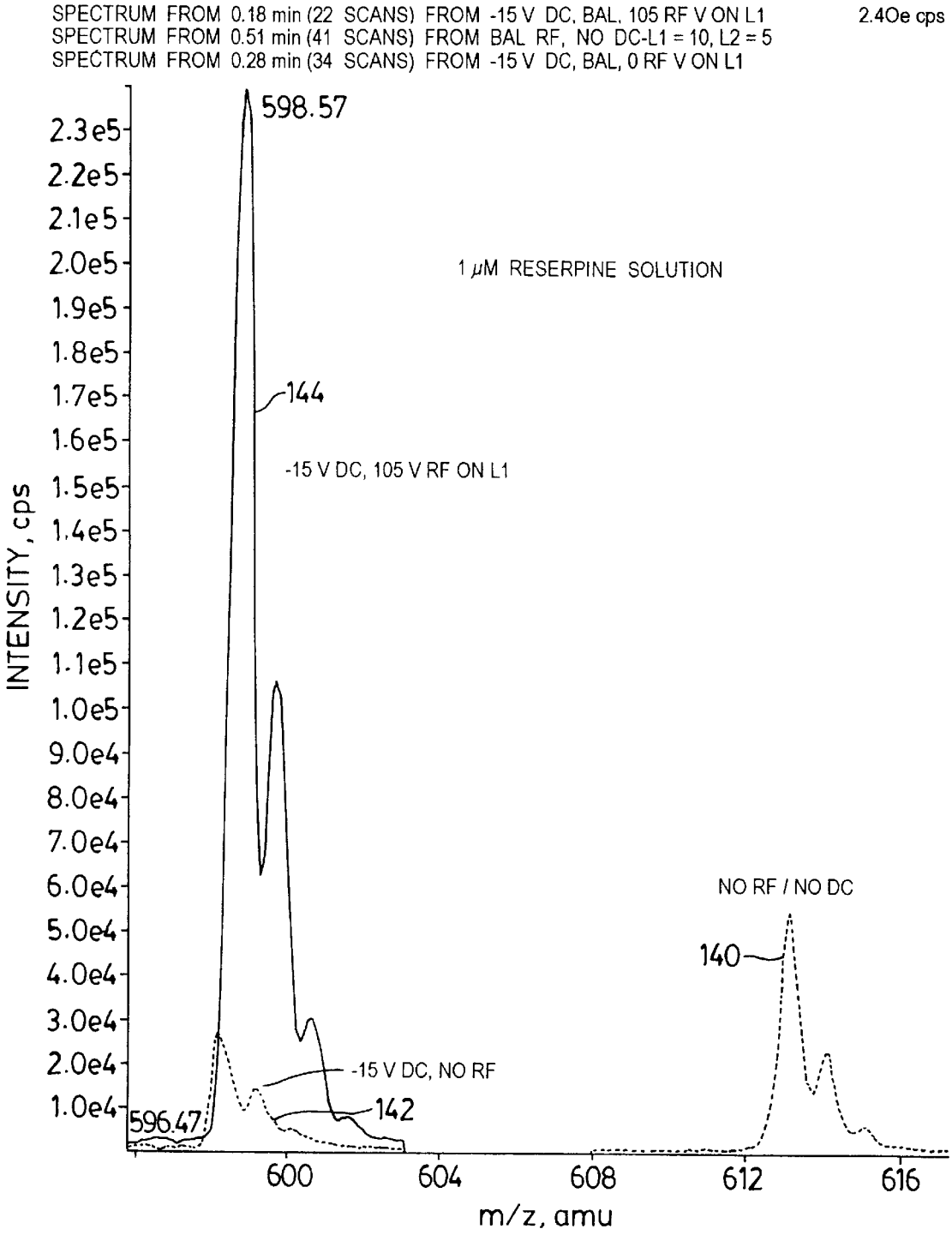
FIG. 21 shows three spectra obtained under three different sets of conditions, to illustrate the effects of the invention.

Reference is next made to FIG. 21, which shows three spectra 140, 142, 144, made from a one micromole reserpine solution. Spectrum 140 was made with balanced RF and no DC applied to the rods Q1, and no RF on the exit lens 39. It will be seen that the intensity was very low.

Spectrum 142 was made with ±15 volts DC on the rods Q1, no RF on the exit lens 39 and balanced RF on the rods Q1. The sensitivity was even lower than that of spectrum 140.

Spectrum 144 was made using ±15 volts DC on the rods Q1, and 105 volts RF on the exit lens 39, properly phased. It will be seen that the sensitivity increased by about a factor of five from spectrum 140.

Figure 22:
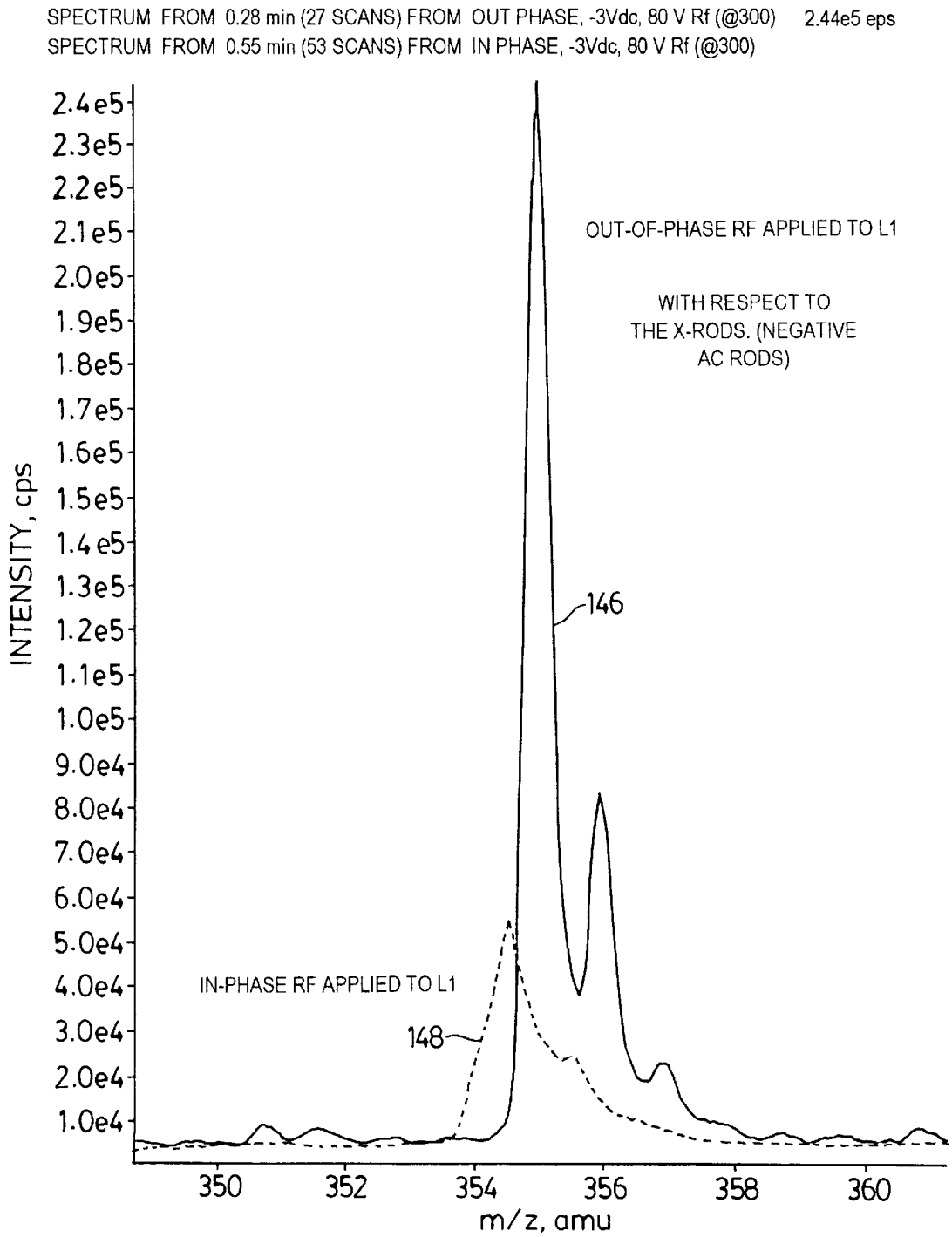
FIG. 22 shows two spectra, obtained with in-phase and out-of-phase RF respectively applied to the end lens.

FIG. 22 shows the effects of varying the phase of the RF applied to the exit lens 39. Spectrum 146 was made with out-of-phase RF applied to exit lens 39, where "out-of-phase" means with respect to the drive RF on the negative or x-rods Q1-2, Q1-4. Spectrum 148 was made with in-phase RF applied to the exit lens 39, i.e., in-phase with respect to the drive RF on the negative or x-rods Q1-2, Q1-4. It will be seen that the sensitivity was much higher when the RF was out-of-phase with the drive RF on the x-rods Q1-2, Q1-4, causing the bulk of the ions (aligned with the y-rods Q1-1, Q1-3) to experience an in-phase field which caused them to spend more time in the fringing fields.

Figure 23:
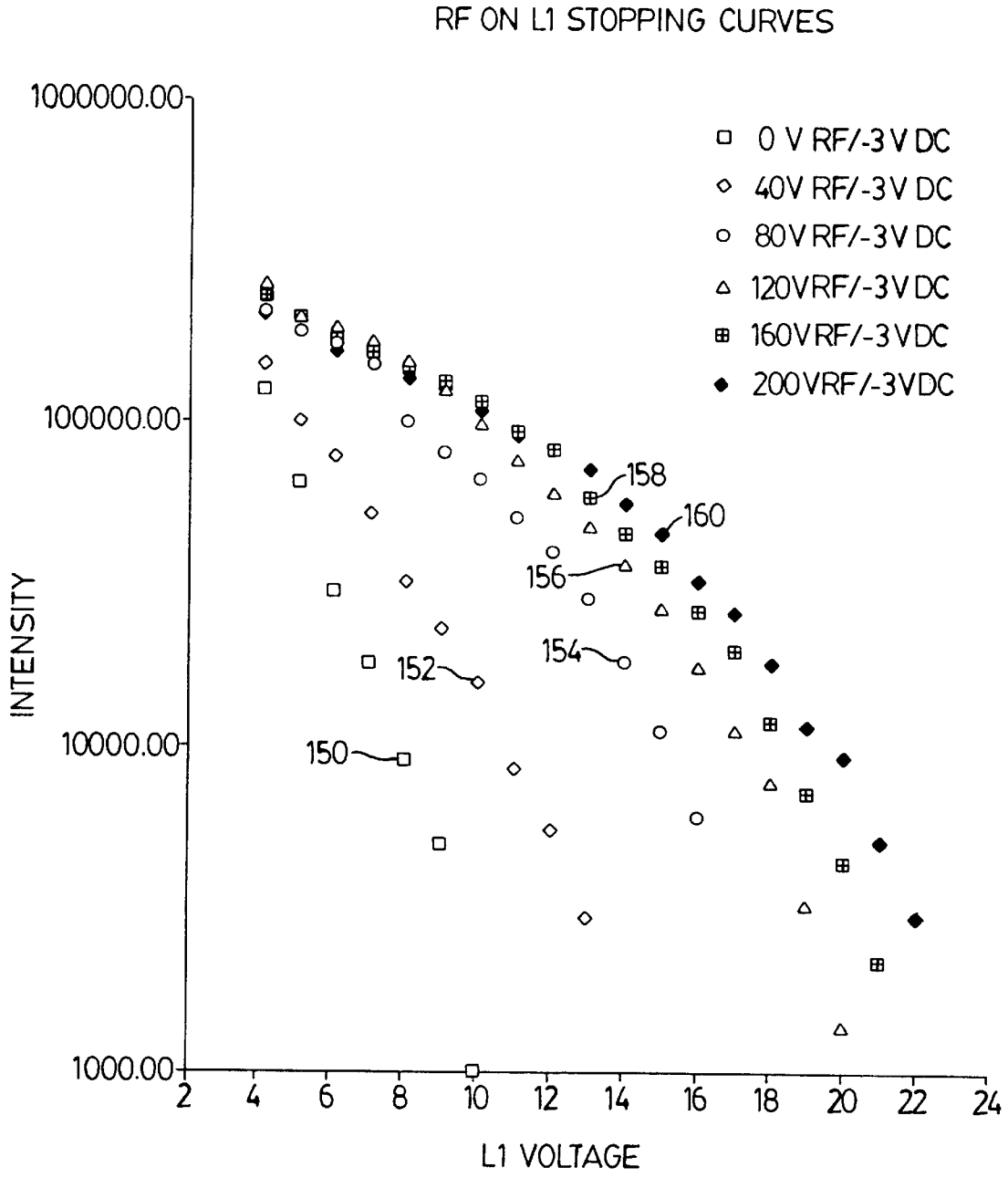
FIG. 23 shows stopping curves produced using low voltage DC on the rods of a mass spectrometer and with different levels of RF applied to the end lens.

FIG. 23 shows stopping curves and illustrates the variation in kinetic energy of ions with variation of the RF amplitude on the exit lens 39. In all cases, balanced RF and ±3 volts DC were applied to the rods Q1.

In FIG. 23, curve 150 is the stopping curve when zero volts RF was applied to the exit lens. It will be seen that the axial kinetic energy of the ions was very low. Curves 152, 154, 156, 158 and 160 show 40 volts, 80 volts, 120 volts, 160 volts and 200 volts, respectively, of RF (peak-to-peak) applied to the exit lens 39 and suitably phased. It will be seen that as the RF voltage applied to the exit lens 39 increases, the axial kinetic energy of the ions increases, although the increases become smaller after the RF voltage has been increased to between 80 and 120 volts.

Figure 24:
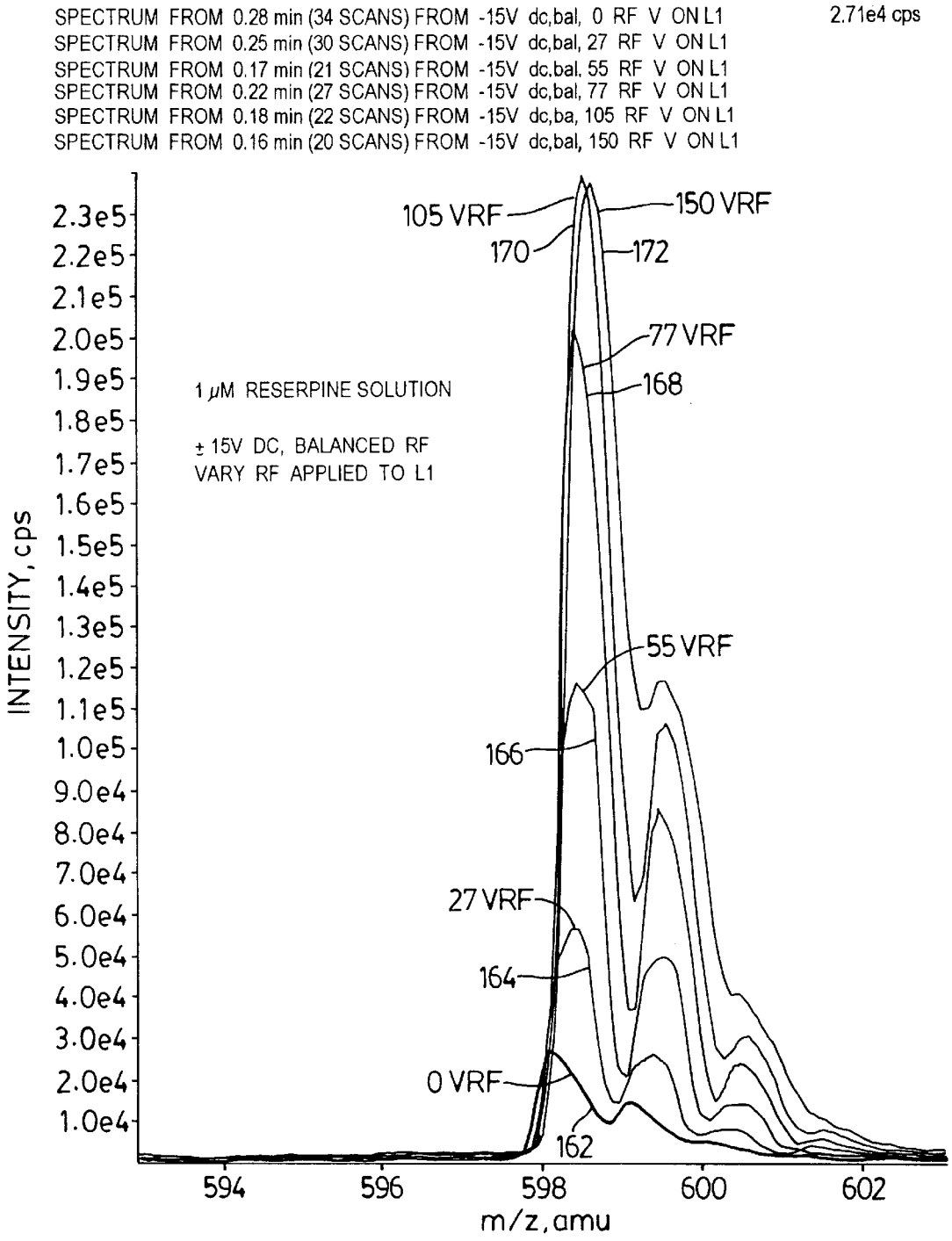
FIG. 24 shows a set of mass spectra obtained using low voltage DC on the spectrometer rods and different RF voltages on the end lens.

FIG. 24 shows spectra obtained from a one micromole reserpine solution, using ±15 volts DC and balanced RF on the rods Q1, and various values of out-of-phase RF on exit lens 39. As would be expected from FIG. 23, it will be seen from FIG. 24 that the intensity increases as the RF on the exit lens 39 increases, but to a limiting value. As the limiting value is approached, peak broadening occurs. Thus, curves 162 to 172 were made at RF voltages of 0 volts, 27 volts, 55 volts, 77 volts, 105 volts and 150 volts RF, respectively (peak-to-peak), on exit lens 39.

In all cases, it is believed that sufficient DC should be applied to align the majority of the ions with one pole pair (subject to the comments made below), and then RF is applied phased to retard the aligned ions, so that they acquire greater kinetic energy in the fringing fields. The phased RF can be applied either by unbalancing the RF on the rods Q1, or by applying RF suitably phased to the exit lens 39 or by other suitable techniques. While some ions may be aligned with the other pole pair (the x-pole pair in FIG. 18), and while these ions may be accelerated through the fringing field by the unbalanced RF or by the RF applied to the exit lens, so that they spend less time in the fringing fields and will therefore be ejected with less kinetic energy, only a relatively few ions will be so affected. The majority of the ions, which are aligned with one pole pair (the y-pole pair in FIG. 18), are retarded so as to spend more time in the fringing field and therefore ejected with greater kinetic energy, as desired. The amount of DC applied may be optimized in each case to yield the best intensity and peak shape (while not applying so much DC as to reduce unduly the bandwidth of the rods, thereby reducing the intensity). The fact that identical performance is achieved with unbalanced RF on the rods of Q1, or with auxiliary RF applied to the exit lens 39 when the Q1 rods have balanced RF applied to them, is evidence that it is the exit rather than the entrance fringing fields that are important for the observed high kinetic energies of the ions leaving the rods Q1.

Figure 25:
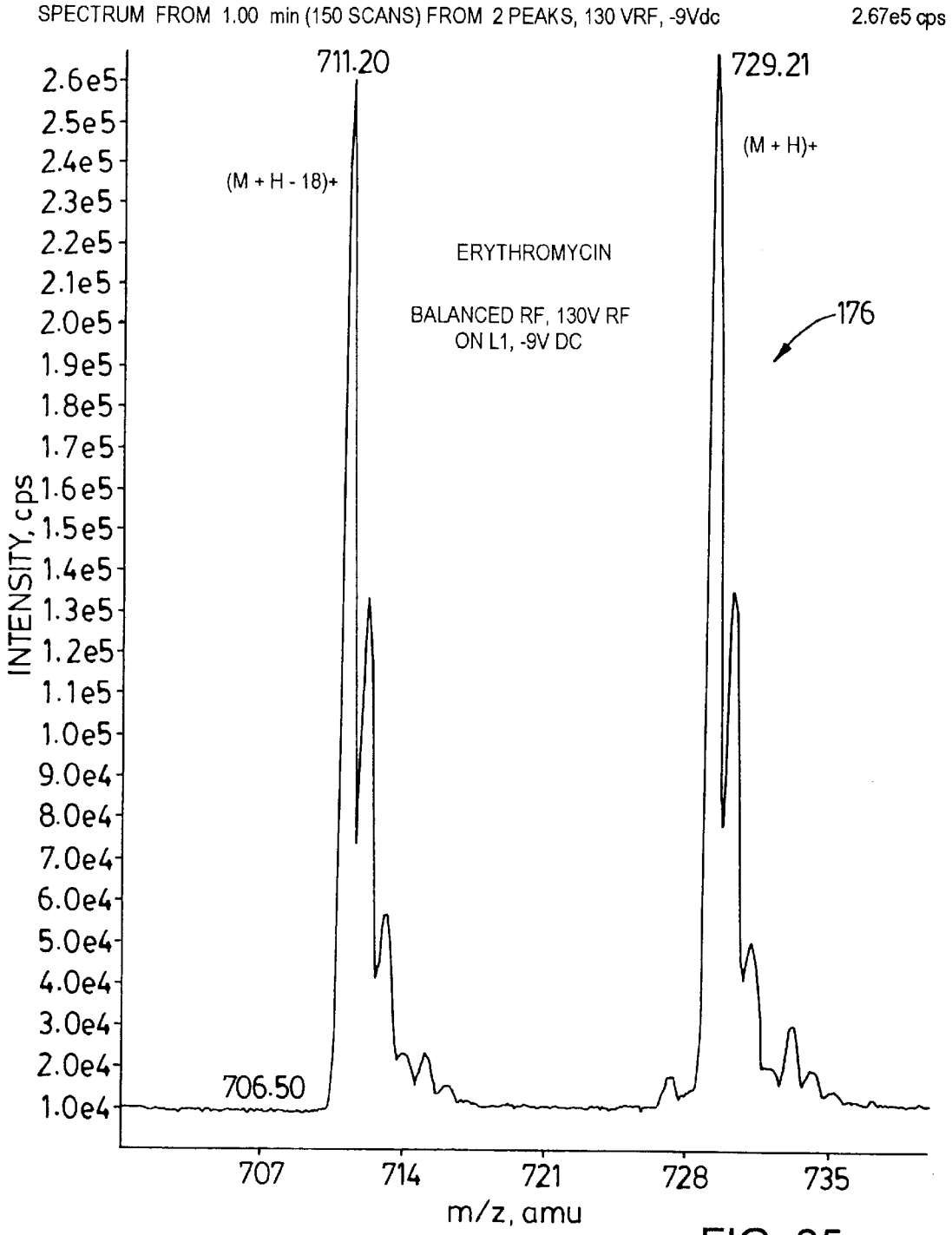
FIG. 25 shows a mass spectrum illustrating the resolution obtained in a high mass range using the invention.

FIG. 25 shows a typical spectrum 176 obtained in a high mass range using the invention. The spectrum shown is that of erythromycin, using balanced RF on the rods Q1, 130 volts RF on the exit lens 39 and ±9 volts DC on the rods Q1. It will be seen that the peaks shown are sharply defined with relatively high intensity as marked on the drawing.

Figure 26:
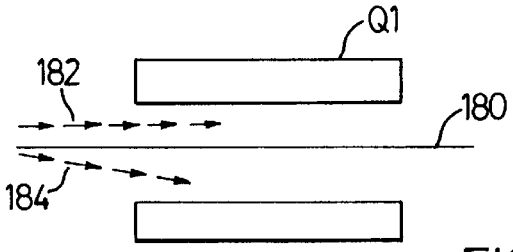
FIG. 26 shows a set of spectrometer rods and illustrates a modification of the invention using modified ion injection.

While the ions at the exit end of Q1 have been described as being aligned with one pole pair by application of a small DC voltage to Q1, other techniques can be used to align the ions with one pole pair. Two examples are shown in FIG. 26, which shows the rods Q1. In one technique, the ions can be injected parallel to the central axis 180 of rods Q1 but spaced radially from the central axis. The line along which the ions are injected is indicated at 182 in FIG. 26. The amount of off-set needed will depend on a number of factors, including particularly the ion beam divergence, the ion energies, and the RF frequency, and will require caseby-case optimization. In many instances, an off-set of 25% of the radius from the centre line to the inner surface of the rods of Q1 ($r_o$ as explained at the beginning of this detailed description) will be sufficient, based on computer simulations.

In the other technique, the ions are injected along a line 184 which is oriented at an angle to the central axis 180 of rods Q1. The preferred injection angle will again be optimized on a case-by-case basis, bearing in mind that if the angle is too large, too many ions will be lost to the rods, and if the angle is too small, the ions would not become aligned sufficiently with one pole pair. In many cases, an injection angle of approximately 5° from the central axis 180 will be appropriate, based on computer simulations. Both these techniques will have the effect of preferentially aligning the majority of the ions with one of the pole pairs, so that they can be made to spend more time in the exit fringing fields with the use of suitably phased or unbalanced RF, and thus can be ejected with greater kinetic energy.

While the invention has been described as directing ions from an ion source into the resolving rods in question, if desired some or all of the ions can instead be formed within the rods, e.g., by ion reactions or by any other desired means.

While preferred embodiments of the invention have been described, it will be appreciated that various modifications will occur to those skilled in the art, and all such changes are intended to be encompassed by the appended claims.

I claim:

1. A method of operating a mass spectrometer having a rod set of two pole pairs and an exit end, said method comprising directing ions into or forming ions in said rod set, transmitting ions from said exit end of said rod set as transmitted ions, modifying an exit fringing field of said mass spectrometer by altering the RF and DC voltages in said fringing field such that said transmitted ions near the stability limit of the mass spectrometer are given greater axial kinetic energy, and detecting ions for analysis.

2. A method according to claim 1 wherein the exit fringing field of said rod set is modified by applying an unbalanced RF voltage to said rod set and by applying DC voltage to said rod set that corresponds to an a-value of about 0.001 to 0.1 in an a-q stability diagram.

3. A method according to claims 1 or 2 wherein said RF voltage is unbalanced by about 10% to 60% peak-to-peak.

4. A method according to claim 3 wherein mass resolution is achieved by energy filtering said transmitted ions.

5. A method according to claim 4 wherein said step of detecting ions for analysis occurs after the step of energy filtering.

6. A method according to claim 1 wherein said mass spectrometer has an exit lens spaced from the exit end of said rod set, and said method further comprises the step of modifying said exit fringing field of said rod set by applying to said exit lens an RF voltage phase locked to the nominally balanced drive RF voltage of said rod set.

7. A method according to claim 6 wherein DC voltage is applied to said rod set that corresponds to an a-value of about 0.001 to 0.1 in an a-q stability diagram.

8. A method according to claim 7 wherein said RF voltage is unbalanced by about 10% to 60 peak-to-peak.

9. A method according to claims 6, 7, or 8 wherein mass resolution is achieved by energy filtering said transmitted ions.

10. A method according to claim 9 wherein said step of detecting ions for analysis occurs after the step of energy filtering.

11. A method of operating a mass spectrometer having a rod set which has at least two pole pairs, a central axis, and an exit end, said method comprising directing ions from said exit end of said rod set as transmitted ions, applying an RF voltage to said rod set, aligning some of said transmitted ions with one said pole pair adjacent said exit end by injecting them into said rod set in a direction parallel to and offset from said central axis, and the number of transmitted ions being aligned with said one pole pair being greater than the number of transmitted ions not so aligned, and ejecting the ions aligned with said one pole pair from said exit end with greater kinetic energy than the ions not so aligned.

* * * * *